US008267152B2

(12) United States Patent
Kagehira et al.

(10) Patent No.: US 8,267,152 B2
(45) Date of Patent: Sep. 18, 2012

(54) TWIN-ROLL CONTINUOUS CASTER

(75) Inventors: Kiyoshi Kagehira, Hiroshima (JP); Tatsunori Sugimoto, Hiroshima (JP)

(73) Assignee: Mitsubishi-Hitachi Metals Machinery, Inc., Tokyo (JP)

( * ) Notice: Subject to any disclaimer, the term of this patent is extended or adjusted under 35 U.S.C. 154(b) by 12 days.

(21) Appl. No.: 12/632,386

(22) Filed: Dec. 7, 2009

(65) Prior Publication Data

US 2010/0175848 A1 Jul. 15, 2010

(30) Foreign Application Priority Data

Jan. 9, 2009 (JP) ..... 2009-003360

(51) Int. Cl.
*B22D 11/06* (2006.01)

(52) U.S. Cl. ..... 164/428

(58) Field of Classification Search ..... 164/428, 164/480

See application file for complete search history.

(56) References Cited

U.S. PATENT DOCUMENTS

| | | | | |
|---|---|---|---|---|
| 2005/0253314 | A1* | 11/2005 | Choi et al. | 266/90 |
| 2008/0169082 | A1* | 7/2008 | Hayasi et al. | 164/480 |

FOREIGN PATENT DOCUMENTS

| | | | |
|---|---|---|---|
| AT | 397 478 | B | 4/1994 |
| DE | 28 56 472 | A1 | 5/1980 |
| DE | 696 05 474 | T2 | 6/2000 |
| DE | 11 2005 002 733 | T5 | 9/2007 |
| GB | 2 034 217 | A | 6/1980 |
| JP | 3-128149 | A * | 5/1991 |
| JP | 3-128149 | A | 5/1991 |
| JP | 2783484 | B2 | 11/1993 |
| JP | 3045212 | B2 | 12/1994 |
| JP | 2004-42128 | A | 2/2004 |
| WO | WO 93/06955 | A1 | 4/1993 |

OTHER PUBLICATIONS

German Office Action issued in German Patent Application No. 10 2009 060 322.0 on Jul. 19, 2011.

* cited by examiner

*Primary Examiner* — Kevin P Kerns

(74) *Attorney, Agent, or Firm* — Birch, Stewart, Kolasch & Birch, LLP

(57) ABSTRACT

In a twin-roll continuous caster configured to cast molten steel supplied to a molten metal pool between cooling rolls into a cast piece by, for example, cooling and solidifying the molten steel on the surfaces of the cooling rolls, the pair of cooling rolls each have ridges on the surface thereof, and cast-piece edges and a cast-piece central portion are generated. Specifically, the cast-piece edges are generated by pressing and bonding lateral edges of one of solidified shells to lateral edges of the other solidified shells, the lateral edges of the solidified shells being produced by cooling and solidifying the molten metal on surfaces of collars provided at lateral end portions of the cooling rolls. The cast-piece central portion contains the unsolidified molten steel between the solidified shells and is generated by cooling and solidifying the molten steel on the surfaces of the laterally central portions of the cooling rolls.

9 Claims, 9 Drawing Sheets

TWIN-ROLL CONTINUOUS CASTER

BACKGROUND OF THE INVENTION

1. Field of the Invention

The present invention relates to a twin-roll continuous caster which includes a pair of cooling rolls having projections or ridges formed on surfaces thereof and which is configured to cast molten metal supplied to a molten metal pool between the pair of cooling rolls into a cast piece by cooling and solidifying the molten metal on the surfaces of the pair of cooling rolls.

2. Description of the Related Art

There has been proposed direct casting of a thin plate with a twin-roll continuous caster including a pair of cooling rolls. Further, with regard to the twin-roll continuous casters, there have also been proposed: slow cooling of molten metal at the time of solidification of the molten metal in order to prevent the cracking of a thin plate; and forming projections or ridges (providing a texture) on the surfaces of the cooling rolls in order to uniformize the thickness of a thin plate (solidified shell) <see, for example, Patent Literatures 1 and 2>. In the case of projections, since the solidification of molten metal such as molten steel starts from the tops of the projections, uniformly placing the projections causes the solidified shells to be uniformly produced and as a result uniformizes the shell thicknesses in the early stages of solidification. Similarly, also in the case of ridges, since the solidification of molten metal such as molten steel starts from the tops of the ridges, placing the ridges uniformly in the lateral direction uniformizes the shell thicknesses at least in the lateral direction.

CITATION LIST

Patent Literature 1
Japanese Patent Application Publication No. 1991-128149
Patent Literature 2
Japanese Patent Application Publication No. 2004-042128
Patent Literature 3
Japanese Patent No. 2783484
Patent Literature 4
Japanese Patent No. 3045212

SUMMARY OF INVENTION

Technical Problem

However, in the above-described conventional twin-roll continuous caster (strip caster) for casting a thin plate, the cooling rolls need to press and bond the solidified shells to each other throughout the widths of the solidified shells using the entire widths (entire axial lengths) of the cooling rolls. The line pressure in the lateral direction of the thin plate at this time is very high, that is, approximately 1 kg/mm to 25 kg/mm <Patent Literature 3> or approximately 9 kg/mm to 40 kg/mm <Patent Literature 4>. Consequently, effects such as the uniformization of solidified shell thicknesses by projections or ridges 2 formed on the surfaces of cooling rolls 1 might be undermined early because damage, worn or the like of the projections or ridges 2 occurs early as shown in FIG. 16.

Accordingly, in view of the above-described circumstances, an object of the present invention is to provide a twin-roll continuous caster in which, for example, increased life of cooling rolls can be achieved by maintaining the shapes of projections or ridges formed on the surfaces of the cooling rolls for a long period and thereby maintaining effects such as the uniformization of solidified shell thicknesses by the projections or ridges for a long period.

Solution of Problem

To achieve the above-described object, a first aspect of the present invention provides a twin-roll continuous caster configured to cast molten metal supplied to a molten metal pool between a pair of cooling rolls into a cast piece by cooling and solidifying the molten metal on surfaces of the pair of cooling rolls. Specifically, projections or ridges are formed in at least laterally central portions on the surfaces of the pair of cooling rolls, laterally opposite edges of the cast piece are generated by cooling and solidifying the molten metal with cast-piece-edge generation means provided on laterally opposite sides of each of the pair of cooling rolls, and a laterally central portion of the cast piece is generated by cooling and solidifying the molten metal on surfaces of the laterally central portions of the pair of cooling rolls, the laterally central portion of the cast piece containing the unsolidified molten metal between solidified shells.

A second aspect of the present invention provides the twin-roll continuous caster according to the first aspect of the present invention. Specifically, the cast-piece-edge generation means has any one of first to third configurations. In the first configuration, the laterally opposite edges of the cast piece are generated by pressing and bonding laterally opposite edges of one of first solidified shells to laterally opposite edges of the other one of the first solidified shells by collars formed at laterally opposite end portions of each of the pair of cooling rolls, the laterally opposite edges of each of the first solidified shells being produced by cooling and solidifying the molten metal on surfaces of the collars. In the second configuration, the laterally opposite edges of the cast piece are generated by pressing and bonding laterally opposite edges of each of second solidified shells respectively to third solidified shells by laterally opposite end portions of each of the pair of cooling rolls, the laterally opposite edges of each of the second solidified shells being produced by cooling and solidifying the molten metal on surfaces of the laterally opposite end portions of each of the pair of cooling rolls, the third solidified shells being produced by cooling and solidifying the molten metal on surfaces of cooling media fed from cooling medium feeding means into a portion between the pair of cooling rolls at the laterally opposite end portions thereof. In the third configuration, the laterally opposite edges of the cast piece are generated by pressing and bonding laterally opposite edges of fourth solidified shell to laterally opposite edges of fifth solidified shell by collars formed at laterally opposite end portions of a first one of the pair of cooling rolls and by laterally opposite end portions of a second one of the pair of cooling rolls, the laterally opposite edges of each of the fourth solidified shell being produced by cooling and solidifying the molten metal on surfaces of the collars of the first cooling roll of the pair of cooling rolls, the laterally opposite edges of each of the fifth solidified shell being produced by cooling and solidifying the molten metal on surfaces of the laterally opposite end portions of the second cooling roll.

A third aspect of the present invention provides the twin-roll continuous caster according to the second aspect of the present invention. In this twin-roll continuous caster: when the cast-piece-edge generation means has the first configuration, the surfaces of the collars of the pair of cooling rolls are flat with no projections and no ridges; when the cast-piece-edge generation means has the second configuration, the surfaces of the laterally opposite end portions of the pair of cooling rolls are flat with no projections and no ridges; and when the cast-piece-edge generation means has the third configuration, the surfaces of the collars of the one cooling roll and the surfaces of the laterally opposite end portions of the other cooling roll are flat with no projections and no ridges.

A fourth aspect of the present invention provides the twin-roll continuous caster according to the second aspect of the present invention. In this twin-roll continuous caster: when the cast-piece-edge generation means has the first configuration, the projections or ridges formed on the surfaces of the collars of each of the pair of cooling rolls have rounded or flatted tops; when the cast-piece-edge generation means has the second configuration, the projections or ridges formed on the laterally opposite end portions of each of the pair of cooling rolls have rounded or flatted tops; and when the cast-piece-edge generation means has the third configuration, the projections or ridges formed on the surfaces of the collars of the one cooling roll and the surfaces of the laterally opposite end portions of the other cooling roll have rounded or flatted tops.

A fifth aspect of the present invention provides the twin-roll continuous caster according to the second aspect of the present invention. In this twin-roll continuous caster: when the cast-piece-edge generation means has the first configuration, the pair of cooling rolls have the projections or ridges on the surfaces of the collars thereof and have greater hardnesses at the surfaces of the collars thereof than at surfaces of portions thereof other than the collars; when the cast-piece-edge generation means has the second configuration, the pair of cooling rolls have the projections or ridges on the surfaces of the laterally opposite end portions thereof and have greater hardnesses at the surfaces of the laterally opposite end portions thereof than at surfaces of portions thereof other than the laterally opposite end portions; and when the cast-piece-edge generation means has the third configuration, the one cooling roll has the projections or ridges on the surfaces of the collars thereof and has greater hardnesses at the surfaces of the collars thereof than at a surface of a portion thereof other than the collars, and the other cooling roll has the projections or ridges on the surfaces of the laterally opposite end portions thereof and has greater hardnesses at the surfaces of the laterally opposite end portions thereof than at a surface of a portion thereof other than the laterally opposite end portions.

A sixth aspect of the present invention provides the twin-roll continuous caster according to any one of the first to fifth aspects of the present invention. Specifically, ridges are formed on the surface of each of the pair of cooling rolls, each of the ridges is discontinuous in a circumferential direction of the cooling roll, and the length of each discontinuous ridge in the circumferential direction is shorter than a circumferential length from a position of a meniscus of the molten metal pool to a kissing point along the surface of the cooling roll.

Advantageous Effects of Invention

The twin-roll continuous caster according to the first aspect of the present invention provides the twin-roll continuous caster configured to cast molten metal supplied to the molten metal pool between the pair of cooling rolls into the cast piece by cooling and solidifying the molten metal on surfaces of the pair of cooling rolls. Specifically, projections or ridges are formed in at least laterally central portions on the surfaces of the pair of cooling rolls, laterally opposite edges of the cast piece are generated by cooling and solidifying the molten metal with cast-piece-edge generation means provided on laterally opposite sides of each of the pair of cooling rolls, and the laterally central portion of the cast piece is generated by cooling and solidifying the molten metal on surfaces of the laterally central portions of the pair of cooling rolls, the laterally central portion of the cast piece containing the unsolidified molten metal between solidified shells. Accordingly, unlike conventional strip casters, solidified shells do not need to be pressed and bonded to each other by the entire surfaces of cooling rolls. The surfaces of the laterally central portions of the cooling rolls are only subject to the static pressure of the molten metal from the laterally central portion of the cast piece which contains the unsolidified molten metal, i.e., only subject to a line pressure (e.g., 0.01 kg/mm or less) much lower than line pressures described in Patent Literatures 3 and 4, which are approximately 1 kg/mm to 25 kg/mm and approximately 9 kg/mm to 40 kg/mm. This makes it possible to reduce the damage and wear of the projections or ridges formed on the surfaces of the laterally central portions of the cooling rolls, maintain the shapes of the projections or ridges for a long period, and maintain effects such as the uniformization of solidified shell thicknesses (cast-piece thicknesses) by the projections or ridges for a long period. That is, it is possible to maintain, for a long period, the function of uniformizing the thicknesses in the laterally central portion of the cast piece which is more important than the laterally opposite edges of the cast piece to be cut away in a step after casting. Thus, the life of the cooling rolls can be increased.

The twin-roll continuous caster according to the second aspect of the present invention provides the twin-roll continuous caster which is according to the first aspect of the present invention and in which the cast-piece-edge generation means has any one of first to third configurations. In the first configuration, the laterally opposite edges of the cast piece are generated by pressing and bonding laterally opposite edges of one of first solidified shells to laterally opposite edges of the other one of the first solidified shells by collars formed at laterally opposite end portions of each of the pair of cooling rolls, the laterally opposite edges of each of the first solidified shells being produced by cooling and solidifying the molten metal on surfaces of the collars. In the second configuration, the laterally opposite edges of the cast piece are generated by pressing and bonding laterally opposite edges of each of second solidified shells respectively to third solidified shells by laterally opposite end portions of each of the pair of cooling rolls, the laterally opposite edges of each of the second solidified shells being produced by cooling and solidifying the molten metal on surfaces of the laterally opposite end portions of each of the pair of cooling rolls, the third solidified shells being produced by cooling and solidifying the molten metal on surfaces of cooling media fed from cooling medium feeding means into the portion between the pair of cooling rolls at the laterally opposite end portions thereof. In the third configuration, the laterally opposite edges of the cast piece are generated by pressing and bonding laterally opposite edges of fourth solidified shell to laterally opposite edges of fifth solidified shell by collars formed at laterally opposite end portions of the first one of the pair of cooling rolls and by laterally opposite end portions of the second one of the pair of cooling rolls, the laterally opposite edges of each of the fourth solidified shell being produced by cooling and solidifying the molten metal on surfaces of the collars of the first cooling roll of the pair of cooling rolls, the laterally opposite edges of each of the fifth solidified shell being produced by cooling and solidifying the molten metal on surfaces of the laterally opposite end portions of the second cooling roll. Accordingly, effects similar to those of the first aspect of the present invention can be obtained. Also, since the cast-piece-edge generation means has the above-described first, second, or third configuration, the laterally opposite edges of the cast piece can reliably be generated with a simple configuration to reliably encapsulate the unsolidified molten metal between the solidified shells.

The twin-roll continuous caster according to the third aspect of the present invention provides the twin-roll continuous caster which is according to the second aspect of the present invention and in which: when the cast-piece-edge generation means has the first configuration, the surfaces of the collars of the pair of cooling rolls are flat with no projections and no ridges; when the cast-piece-edge generation means has the second configuration, the surfaces of the laterally opposite end portions of the pair of cooling rolls are flat with no projections and no ridges; and when the cast-piece-edge generation means has the third configuration, the surfaces of the collars of the one cooling roll and the surfaces of the laterally opposite end portions of the other cooling roll are flat with no projections and no ridges. Accordingly, effects similar to those of the second aspect of the present invention can be obtained. Also, no matter which of the above-described first, second, and third configurations the cast-piece-edge generation means has, the collars or laterally opposite end portions of the cooling rolls are free from the problem of damage and wear of the projections or ridges. That is, no matter which of the above-described first, second, and third configurations the cast-piece-edge generation means has, since obtaining effects of ridges is not necessarily important with regard to the laterally opposite end portions as long as the solidified shells can reliably be bonded to each other by pressure, flatting the surfaces of the collars or axial end portions of the cooling rolls makes the collars or laterally opposite end portions of the cooling rolls free from the problem of damage and wear of the projections or ridges.

The twin-roll continuous caster according to the fourth aspect of the present invention provides the twin-roll continuous caster which is according to the second aspect of the present invention and in which: when the cast-piece-edge generation means has the first configuration, the projections or ridges formed on the surfaces of the collars of each of the pair of cooling rolls have rounded or flatted tops; when the cast-piece-edge generation means has the second configuration, the projections or ridges formed on the laterally opposite end portions of each of the pair of cooling rolls have rounded or flatted tops; and when the cast-piece-edge generation means has the third configuration, the projections or ridges formed on the surfaces of the collars of the one cooling roll and the surfaces of the laterally opposite end portions of the other cooling roll have rounded or flatted tops. Accordingly, effects similar to those of the second aspect of the present invention can be obtained. Also, no matter which of the above-described first, second, and third configurations the cast-piece-edge generation means has, the damage and wear of the projections or ridges can be reduced while the uniformization of the solidified shell thicknesses is being maintained to a certain extent in the collars or axially opposite end portions of each cooling roll, which are subject to a high line pressure to bond the solidified shells to each other by pressure. Moreover, formed in the collars of the cooling rolls, the projections or ridges can prevent a transverse travel of the solidified shells from occurring when the solidified shells are pressed and bonded to each other by the collars of the cooling rolls.

The twin-roll continuous caster according to the fifth aspect of the present invention provides the twin-roll continuous caster which is according to the second aspect of the present invention and in which: when the cast-piece-edge generation means has the first configuration, the pair of cooling rolls have the projections or ridges on the surfaces of the collars thereof and have greater hardnesses at the surfaces of the collars thereof than at surfaces of portions thereof other than the collars; when the cast-piece-edge generation means has the second configuration, the pair of cooling rolls have the projections or ridges on the surfaces of the laterally opposite end portions thereof and have greater hardnesses at the surfaces of the laterally opposite end portions thereof than at surfaces of portions thereof other than the laterally opposite end portions; and when the cast-piece-edge generation means has the third configuration, the one cooling roll has the projections or ridges on the surfaces of the collars thereof and has greater hardnesses at the surfaces of the collars thereof than at the surface of the portion thereof other than the collars, and the other cooling roll has the projections or ridges on the surfaces of the laterally opposite end portions thereof and has greater hardnesses at the surfaces of the laterally opposite end portions thereof than at the surface of the portion thereof other than the laterally opposite end portions. Accordingly, effects similar to those of the second aspect of the present invention can be obtained. Also, no matter which of the above-described first, second, and third configurations the cast-piece-edge generation means has, the damage and wear of the projections or ridges can be reduced in the collars or axially opposite end portions of each cooling roll, which are subject to a high line pressure to bond the solidified shells to each other by pressure. Moreover, formed in the collars of the cooling rolls, the projections or ridges can prevent a transverse travel of the solidified shells from occurring when the solidified shells are pressed and bonded to each other by the collars of the cooling rolls.

The twin-roll continuous caster according to the sixth aspect of the present invention provides the twin-roll continuous caster which is according to any one of the first to fifth aspects of the present invention and in which ridges are formed on the surface of each of the pair of cooling rolls, each of the ridges is discontinuous in the circumferential direction of the cooling roll, and the length of each discontinuous ridge in the circumferential direction is shorter than the circumferential length from the position of the meniscus of the molten metal pool to the kissing point along the surface of the cooling roll. Accordingly, effects similar to those of the first to fifth aspects of the present invention can be obtained. Also, a liquid cooling medium sprayed onto the cast piece by the cast-piece cooling means can be prevented from rising through the valleys between the ridges and reaching the position of the meniscus of the molten metal pool.

DETAILED DESCRIPTION OF THE INVENTION

With reference to the drawings, embodiments of the present invention will be described in detail below.

First Embodiment

Figure 1:
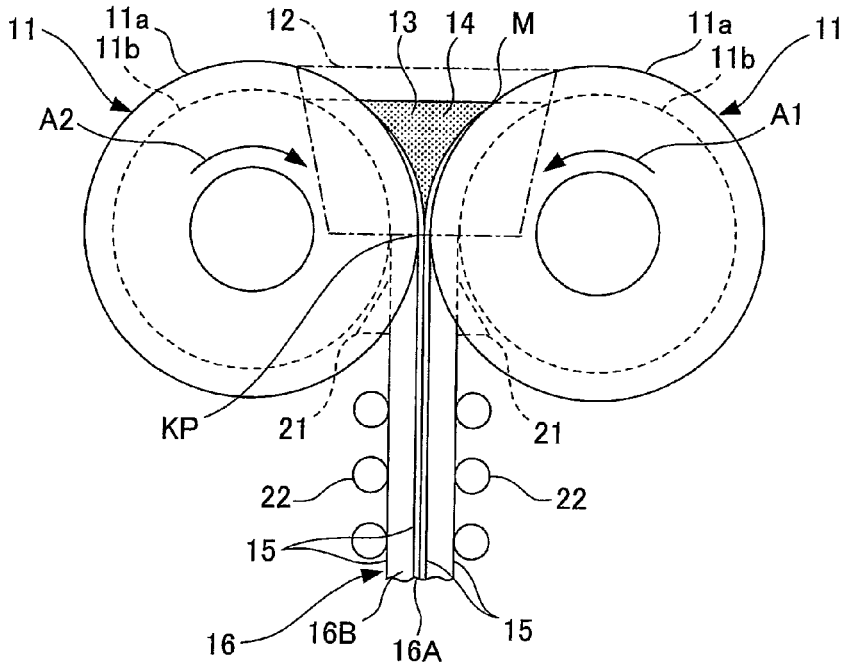
FIG. 1 is a front view of a twin-roll continuous caster according to a first embodiment of the present invention.
Figure 2:
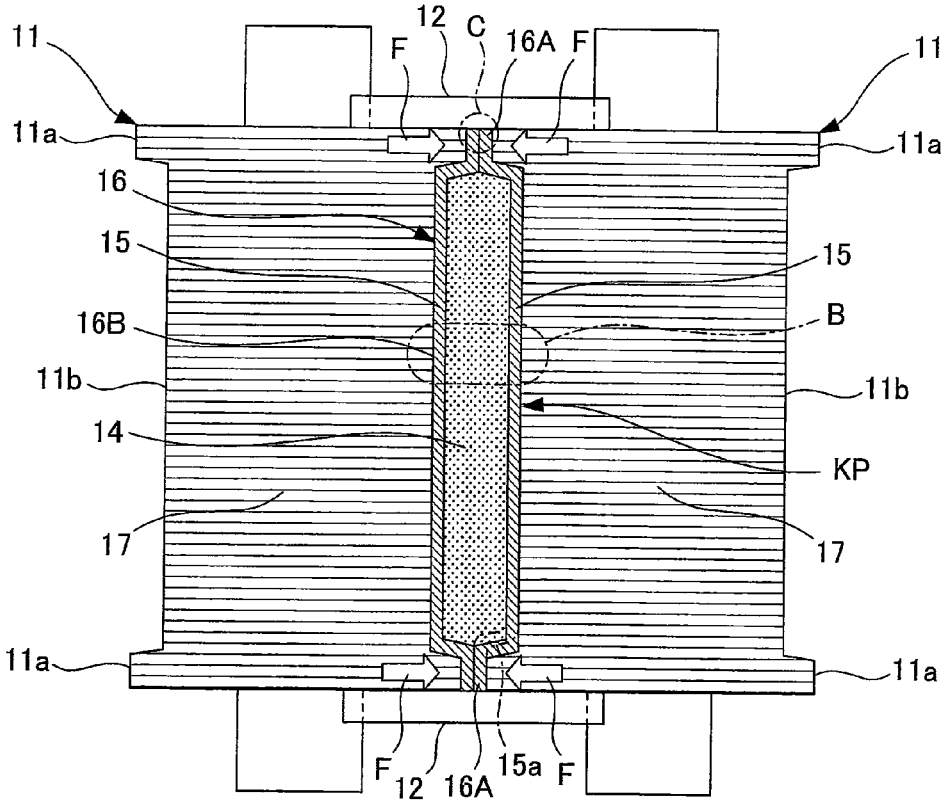
FIG. 2 is a top view of the above-described twin-roll continuous caster.
Figure 3:
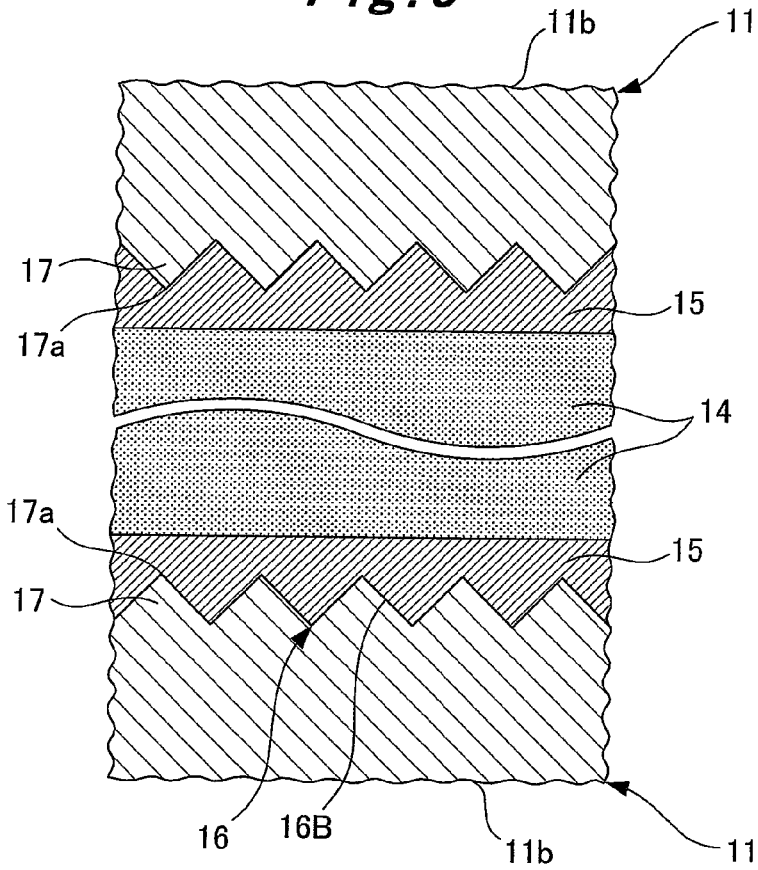
FIG. 3 is an enlarged cross-sectional view showing the configuration of part B (laterally central portions of cooling rolls) of FIG. 2.
Figure 4:
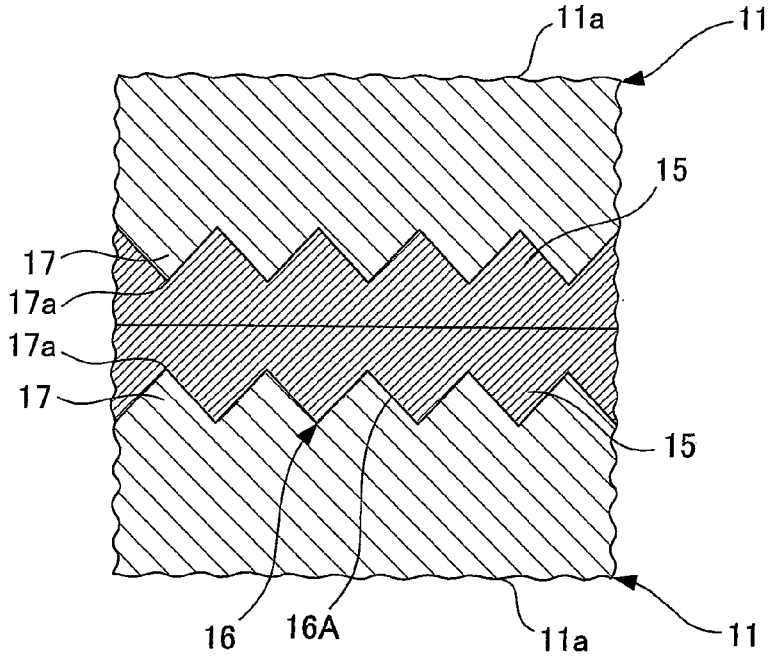
FIG. 4 is an enlarged cross-sectional view showing a configuration of part C (lateral end portions of the cooling rolls) of FIG. 2.

FIG. 1 is a front view of a twin-roll continuous caster according to a first embodiment of the present invention. FIG. 2 is a top view of the twin-roll continuous caster. FIG. 3 is an enlarged cross-sectional view showing the configuration of part B (laterally central portions of cooling rolls) of FIG. 2. FIG. 4 is an enlarged cross-sectional view showing a configuration of part C (lateral end portions of the cooling rolls) of FIG. 2. FIGS. 5A to 5D are enlarged cross-sectional views showing other configuration examples of part C (lateral end portions of the cooling rolls) of FIG. 2.

As shown in FIGS. 1 and 2, the twin-roll continuous caster of the first embodiment includes a pair of cooling rolls 11 and a pair of edge dams 12. The cooling rolls 11 are placed parallel and close to each other at the same height. The edge dams 12 are respectively placed on laterally opposite sides of the cooling rolls 11 and in contact with laterally opposite end portions (axial end portions; upper and lower end portions in FIG. 2) of each cooling roll 11. The space which is between the pair of cooling rolls 11 and bracketed by the edge dams 12 is a molten metal pool 13. This molten metal pool 13 is supplied with molten steel 14 as molten metal through a nozzle from unillustrated supply means such as a tundish, wherein the molten steel 14 is pooled.

Each of the pair of cooling rolls 11 is a cylinder (or column) made of a copper alloy or the like, and has collars 11*a* at the laterally opposite end portions thereof along the entire circumference of the cooling roll 11. The outside diameter of each collar 11*a* is greater than the outside diameter of a laterally central portion 11*b* (portion between the collars 11*a*) of the cooling roll 11.

Accordingly, when the pair of cooling rolls 11 are rotated in opposite directions (see arrows A1 and A2 in FIG. 1) by unillustrated rotation drive means, the molten steel 14 supplied to the molten metal pool 13 is cooled by making contact with the surfaces (the surfaces of the laterally central portions 11*b* and the surfaces of the collars 11*a*) of the pair of cooling rolls 11 to solidify into solidified shells 15, respectively. These solidified shells 15 grow with the rotation of the cooling rolls 11.

At a kissing point KP (position at which the distance between the cooling rolls 11 is smallest) in the space (molten metal pool 13) between the pair of cooling rolls 11, laterally opposite edges of each solidified shell 15 are respectively produced by cooling and solidifying the molten steel 14 on the surfaces of the collars 11*a* formed at the laterally opposite end portions of each cooling roll 11. Then, the laterally opposite edges of one of the solidified shells 15 are pressed and bonded to the laterally opposite edges of the other solidified shell 15 by the collars 11*a* of the pair of cooling rolls 11 as indicated by arrows F in FIG. 2. In this way, laterally opposite edges 16A (upper and lower edges in FIG. 2, hereinafter referred to as cast-piece edges) of a cast piece 16 are generated (cast-piece-edge generation means).

Also, at this time, unsolidified molten steel 14 remains between the laterally central portions of the solidified shells 15, and a portion (i.e., a portion between the cast-piece edges 16A) which contains this unsolidified molten steel 14 becomes a laterally central portion 16B (hereinafter referred to as a cast-piece center) of the cast piece 16. In this way, the pouched cast piece 16 including the cast-piece center 16B containing the unsolidified molten steel 14 and the cast-piece edges 16A (portions not containing the unsolidified molten steel 14) is continuously casted. It should be noted that in the shown example, the cast piece 16 drawn out from the kissing point KP is supported by support members 21 and support rolls 22.

The surfaces (the surfaces of the laterally central portions 11*b* and the surfaces of the collars 11*a*) of the pair of cooling rolls 11 have a large number of ridges 17 formed along the entire circumferences of the cooling rolls 11. This uniformizes the thicknesses of the solidified shells 15 when the molten steel 14 is cooled on the surfaces of the cooling rolls 11 to produce the solidified shells 15.

As shown in FIG. 3, each of the ridges 17 formed on the surfaces of the laterally central portions 11*b* of the cooling rolls 11 has a triangular transverse cross section (cross section taken along the lateral direction of the cooling roll 11). In other words, this ridge 17 has a shape in which a protrusion having a triangular transverse cross section extends along the surface of the cooling roll 11. As shown in FIG. 4, each of the ridges 17 formed on the surfaces of the collars 11*a* of the cooling rolls 11 also has a triangular transverse cross section (cross section taken along the lateral direction of the cooling roll 11). In other words, this ridge 17 also has a shape in which a protrusion having a triangular transverse cross section extends along the surface of the cooling roll 11.

Figure 5A:
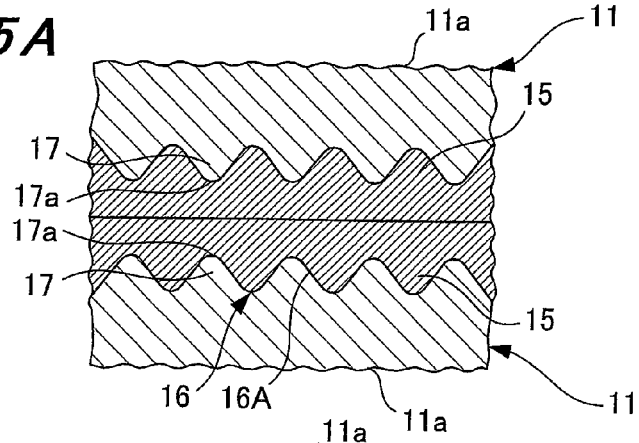
FIGS. 5A to 5D are enlarged cross-sectional views showing other configuration examples of part C (lateral end portions of the cooling rolls) of FIG. 2.
Figure 5B:
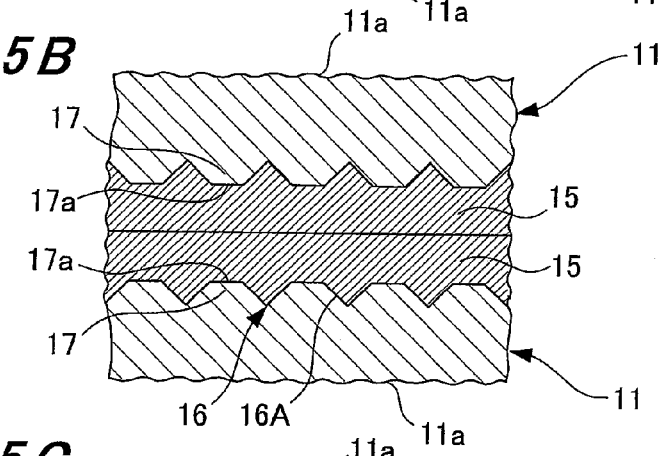

It should be noted, however, that each of the ridges 17 formed on the collars 11*a* of the cooling rolls 11 preferably has a structure such as shown in FIG. 5A or 5B. Although the top 17*a* of the ridge 17 in FIG. 4 is sharp, the top 17*a* of the ridge 17 in FIG. 5A is rounded, and the top 17*a* of the ridge 17 in FIG. 5B is flatted.

Figure 5C:
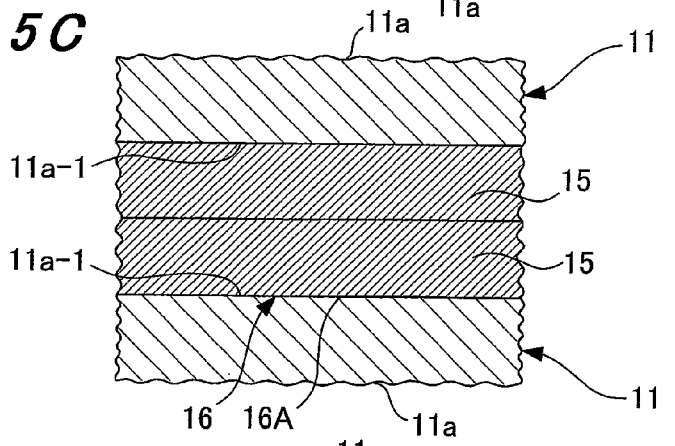
Figure 5D:
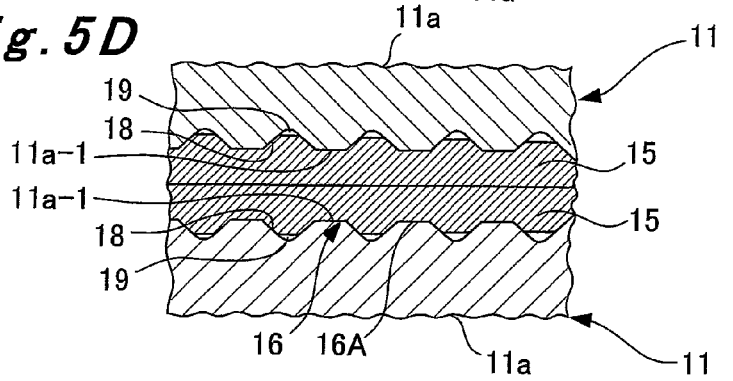

In the collars 11*a* of the cooling rolls 11, structures shown in FIGS. 5C and 5D are also effective. In FIG. 5C, no ridges 17 are formed on the surfaces of the collars 11*a*, and the surfaces (outer peripheries 11*a*-1) of the collars 11*a* are flat. In FIG. 5D, the surfaces of the collars 11*a* have no ridges 17 but have a large number of dimples 18. It should be noted that in this case, since an air gap 19 is formed between the cast-piece edge 16A (solidified shell 15) and the collar 11*a* in each dimple 18, the thickness of the cast-piece edge 16A (solidified shells 15) is relatively small.

It should be noted that the ridges 17 may be formed diagonally with respect to the circumferential directions of the cooling rolls 11 or formed along the lateral directions of the cooling rolls 11, instead of being formed along the circumferential directions of the cooling rolls 11 as described above.

As described above, the twin-roll continuous caster of the first embodiment is a twin-roll continuous caster configured to cast the molten steel 14 supplied to the molten metal pool 13 between the pair of cooling rolls 11 into the cast piece 16 by cooling and solidifying the molten steel 14 on the surfaces of the pair of cooling rolls 11. This twin-roll continuous caster has the following features: the ridges 17 are formed on the surfaces of the pair of cooling rolls 11; the cast-piece edges 16A are generated by cooling and solidifying the molten steel 14 with the cast-piece-edge generation means (collars 11*a*) provided at the laterally opposite end portions of each of the pair of cooling rolls 11; and the cast-piece center 16B containing the unsolidified molten steel 14 between the solidified shells 15 is produced by cooling and solidifying the molten steel 14 on the surfaces of the laterally central portions 11*b* of the pair of cooling rolls 11. Accordingly, unlike conventional strip casters, solidified shells do not need to be pressed and bonded to each other by the entire surfaces of cooling rolls. The surfaces of the laterally central portions 11*b* of the cooling rolls 11 are only subject to the static pressure of the molten steel 14 from the cast-piece center 16B containing the unsolidified molten steel 14, i.e., only subject to a line pressure (e.g., 0.01 kg/mm or less) much lower than line pressures described in Patent Literatures 3 and 4, which are approximately 1 kg/mm to 25 kg/ram and approximately 9 kg/mm to 40 kg/mm.

For example, if the density p of the molten steel is 7200 $kg/m^3$ and the head H of the molten steel in the molten metal pool is 0.5 m (diameter r of each cooling roll is 1.2 m), the static pressure P of the molten steel will be calculated as follows: $P=\rho H=7200\times0.5=3600\ kg/m^3=0.0036\ kg/mm^2$. Thus, the line pressure for a length of 1 mm along the casting direction will be 0.0036 mm.

Accordingly, it is possible to reduce the damage and wear of the ridges 17 formed on the surfaces of the laterally central portions 11*b* of the cooling rolls 11, maintain the shapes of the ridges 17 for a long period, and maintain effects such as the uniformization of solidified shell thicknesses (cast-piece thicknesses) by the ridges 17 for a long period. That is, it is possible to maintain, for a long period, the function of uniformizing the thicknesses in the cast-piece center 16B which is more important than the cast-piece edges 16A to be cut away in a step after casting. Thus, the life of the cooling rolls 11 can be increased.

Moreover, the twin-roll continuous caster of the first embodiment has the following feature: the cast-piece-edge generation means has a configuration (first configuration) in which the cast-piece edges 16B are generated by pressing and bonding, by the collars 11*a* of the pair of cooling rolls 11, the laterally opposite edges of one of the solidified shells 15 to the laterally opposite edges of the other solidified shells 15, the laterally opposite edges being respectively produced by cooling and solidifying the molten steel 14 on the surfaces of the collars 11*a* formed at the laterally opposite end portions of each of the pair of cooling rolls 11. Accordingly, the cast-piece edges 16A can reliably be generated with a simple configuration to reliably encapsulate the unsolidified molten steel 14 between the solidified shells 15.

Further, in the twin-roll continuous caster of the first embodiment, in the case where the surfaces of the collars 11*a* of the pair of cooling rolls 11 are flat with no ridges, the collars 11*a* of the cooling rolls 11 are free from the problem of damage and wear of ridges. That is, with regard to the cast-piece edges 16A, since obtaining effects of ridges is not necessarily important as long as the solidified shells can reliably be bonded to each other by pressure, flatting the surfaces of the collars 11*a* of the cooling rolls 11 makes the collars 11*a* of the cooling rolls 11 free from the problem of damage and wear of the ridges.

Furthermore, in the twin-roll continuous caster of the first embodiment, rounding or flatting the tops of the ridges 17 formed on the surfaces of the collars 11*a* of the pair of cooling rolls 11 can reduce the damage and wear of the ridges 17 while maintaining the uniformization of the solidified shell thicknesses to a certain extent in the collars 11*a* of each cooling roll 11, which are subject to a high line pressure to bond the solidified shells 15 to each other by pressure. Also, since the ridges 17 are formed in the collars 11*a* of the cooling rolls 11, the ridges 17 can prevent a transverse travel 15*a* of the solidified shells 15, as indicated by a dashed-dotted line in FIG. 2, from occurring when the solidified shells 15 are bonded to each other by pressure.

It should be noted that instead of the ridges 17 formed on the surfaces of the cooling rolls 11 in the above-described example, projections (not protrusions, such as ridges, having shapes extending along the surfaces of the cooling rolls, but protrusions having conical shapes, pyramidal shapes, or the like and scattered on the surfaces of the cooling rolls) may be formed on the surfaces of the cooling rolls 11 to uniformize the solidified shell thicknesses. It should be noted, however, that also in this case, the tops of the projections in the collars 11*a* of the cooling rolls 11 are preferably rounded or flatted as in the case of ridges. Further, the collars 11*a* of the cooling rolls 11 may have no projections or may have dimples.

Second Embodiment

Figures 6A, 6B, 6C:
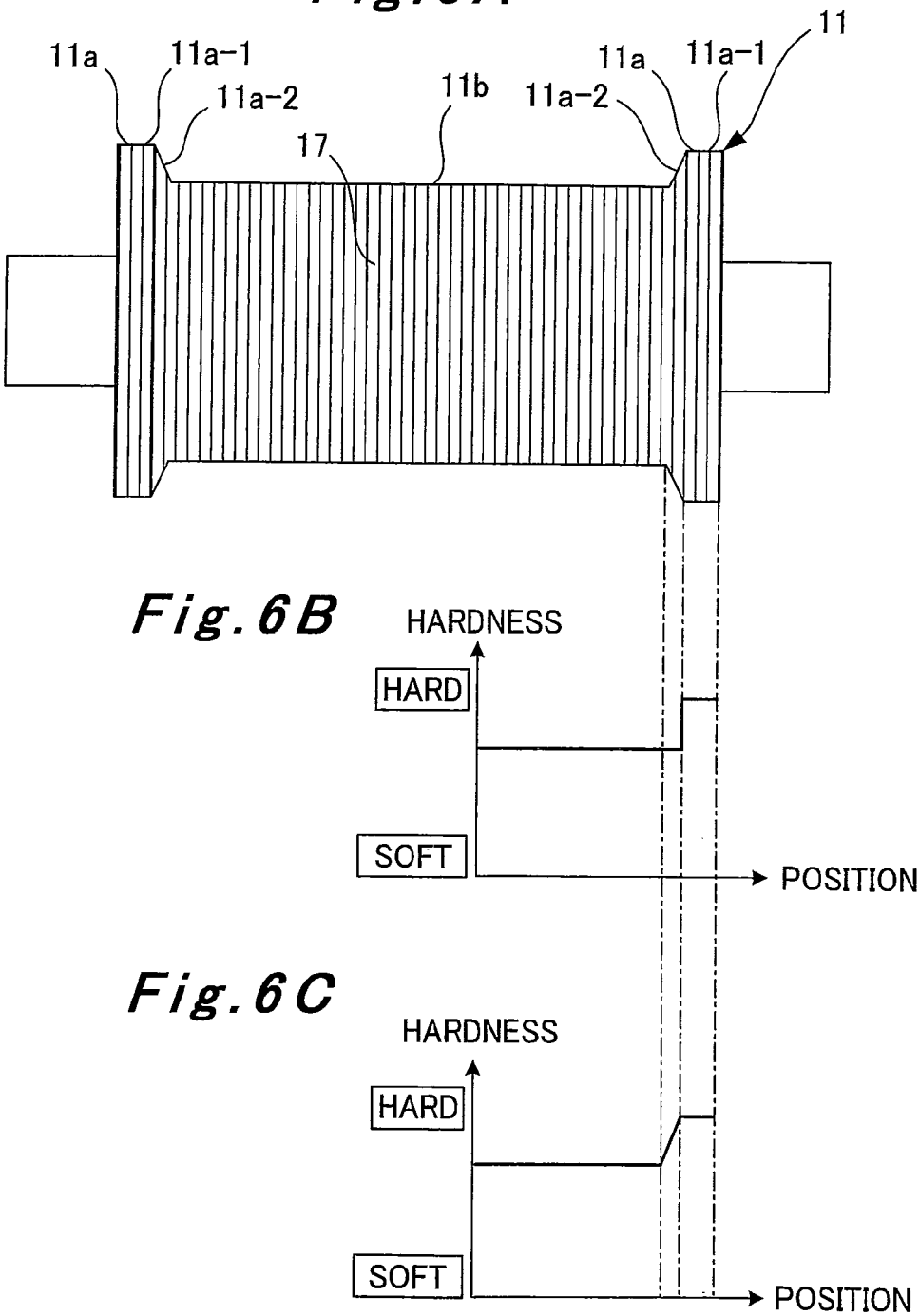
FIG. 6A is a side view of a cooling roll provided in a twin-roll continuous caster according to a second embodiment of the present invention.
FIG. 6B is a view showing a hardness distribution on the surface of the above-described cooling roll.
FIG. 6C is a view showing another hardness distribution on the surface of the above-described cooling roll.

FIG. 6A is a side view of a cooling roll provided in a twin-roll continuous caster according to a second embodiment of the present invention. FIG. 6B is a view showing a hardness distribution on the surface of the cooling roll. FIG. 6C is a view showing another hardness distribution on the surface of the cooling roll.

It should be noted that though FIG. 6A shows only one of the pair of cooling rolls 11, the other cooling roll 11 also has the same configuration as this one. Further, the overall configuration of the twin-roll continuous caster of the second embodiment is similar to that of the aforementioned first embodiment (see FIGS. 1 and 2), and therefore will not be shown or described in detail here.

While the entire surface of the cooling roll 11 has a uniform hardness in the aforementioned first embodiment, the hardness of the cooling roll 11 differs between the laterally central portion and each lateral end portion thereof in the second embodiment. This point will be described in detail below.

As shown in FIG. 6A, the surface (the surface of the laterally central portion 11*b* and the surfaces of the collars 11*a*) of the cooling roll 11 has a large number of ridges 17 formed along the entire circumference of the cooling roll 11. In this regard, the second embodiment is similar to the aforementioned first embodiment (see FIGS. 2 to 5D). However, in the second embodiment, as shown in FIGS. 6B and 6C, the cooling roll 11 has greater hardnesses at the surfaces of the collars

11*a* thereof than at the surface (e.g., copper alloy) of a portion (laterally central portion 11*b*) thereof other than the collars 11*a*.

It should be noted that in the collar 11*a* shown in FIG. 6A, the side surface 11*a*-2 thereof on the inner side with respect to the lateral direction of the cooling roll 11 is an inclined surface diagonally rising as in the aforementioned first embodiment (see FIG. 2). In FIG. 6B, hardness is constant from the portion other than the collar 11*a* to the side surface (inclined surface) 11*a*-2 of the collar 11*a* but jumps to a greater level at the outer periphery 11*a*-1 of the collar 11*a*. In FIG. 6C, hardness is gradually increased in the side surface (inclined surface) 11*a*-2 of the collar 11*a* from the level of the portion other than the collar 11*a*, and becomes greatest at the outer periphery 11*a*-1 of the collar 11*a*.

It should be noted that, in order to increase the hardness of the surface of the collar 11*a* as in FIG. 6B or 6C, for example, a material such as ceramic coating, Ni plating, Cr plating, Ni—W alloy, Ni—P alloy, Ni—B alloy, or Ni—W—B alloy is provided to the surface of the collar 11*a* by thermal spraying or the like, and the hardness is varied by changing the thickness, composition, and the like thereof.

As described above, the twin-roll continuous caster of the second embodiment has the following features: the ridges 17 are formed on the surfaces of the collars 11*a* of the pair of cooling rolls 11, and the cooling rolls 11 have greater hardnesses at the surfaces of the collars 11*a* thereof than at the surfaces of the portions thereof other than the collars 11*a*. Accordingly, in the collars 11*a* of each cooling roll 11, which are subject to a high line pressure to bond the solidified shells 15 to each other by pressure, the damage and wear of the ridges 17 can be reduced. Moreover, since the collars 11*a* of the cooling rolls 11 have the ridges 17, the ridges 17 can prevent the transverse travel of the solidified shells 15 from occurring when the solidified shells 15 are bonded to each other by pressure with the collars 11*a* of the cooling rolls 11.

It should be noted that instead of the ridges 17 formed on the surfaces of the cooling rolls 11 in the above-described example, projections (not protrusions, such as ridges, having shapes extending along the surfaces of the cooling rolls, but protrusions having conical shapes, pyramidal shapes, or the like and scattered oh the surfaces of the cooling rolls 11) may be formed on the surfaces of the cooling rolls 11. It should be noted, however, that also in this case, the tops of the projections in the collars 11*a* of the cooling rolls 11 are preferably rounded or flatted as in the case of ridges. Further, the collars 11*a* of the cooling rolls 11 may have no projections or may have dimples.

Third Embodiment

Figure 7:
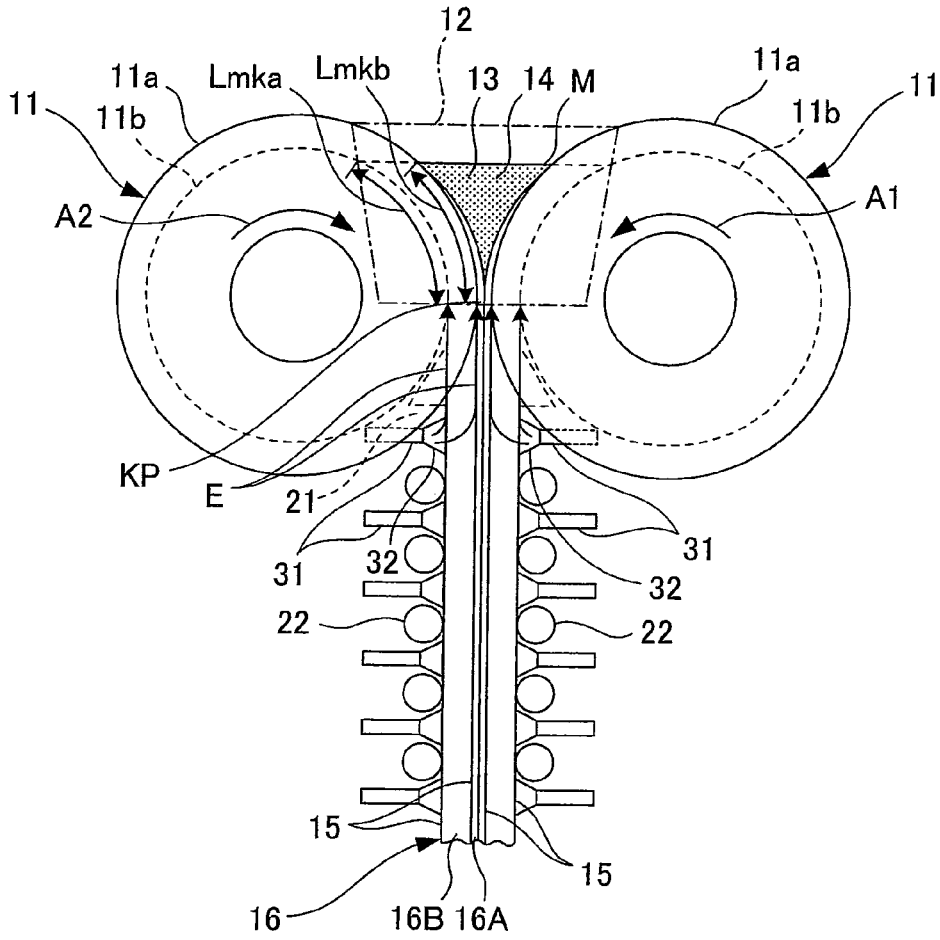
FIG. 7 is a front view of a twin-roll continuous caster according to a third embodiment of the present invention.
Figure 8:
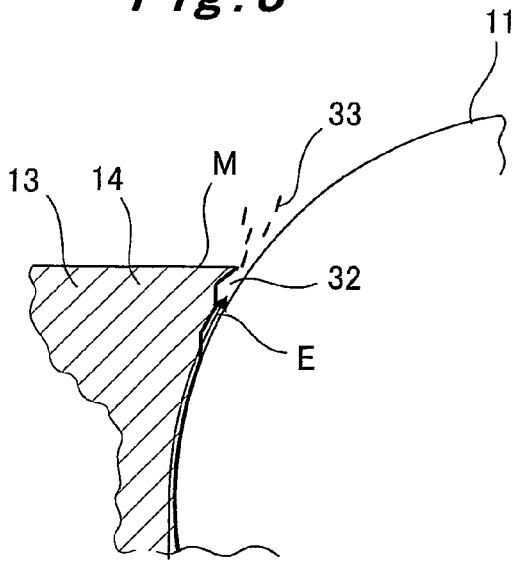
FIG. 8 is an explanatory diagram showing a problem which may occur in the case where ridges are provided on the surface of a cooling roll.
Figure 9A:
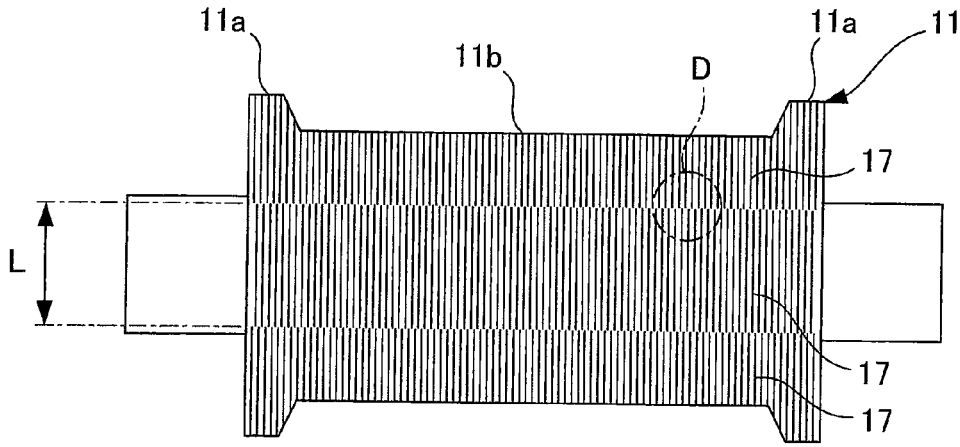
FIG. 9A is a side view of a cooling roll provided in the above-described twin-roll continuous caster.
Figure 9B:
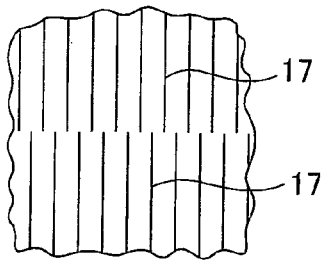
FIG. 9B is an enlarged view of part D of FIG. 9A.
Figure 10:
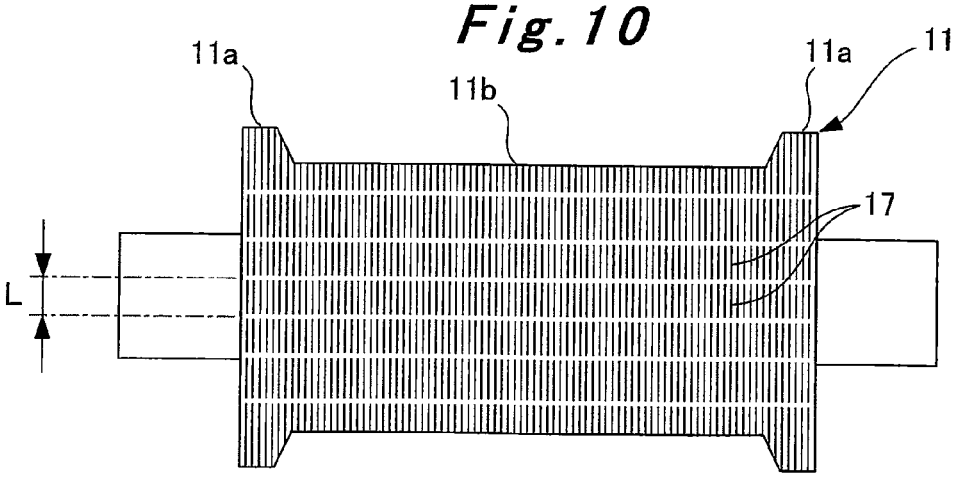
FIG. 10 is a side view of another cooling roll provided in the above-described twin-roll continuous caster.
Figure 11A:
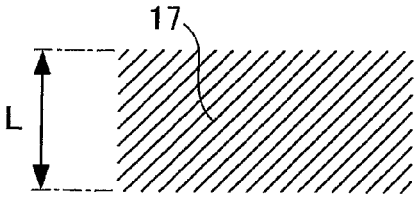
FIGS. 11A and 11B are explanatory diagrams about the lengths of diagonal ridges.
Figure 11B:
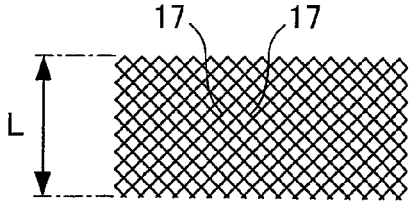

FIG. 7 is a front view of a twin-roll continuous caster according to a third embodiment of the present invention. FIG. 8 is an explanatory diagram showing a problem which may occur in the case where ridges are provided on the surface of a cooling roll. FIG. 9A is a side view of a cooling roll provided in the twin-roll continuous caster. FIG. 9B is an enlarged view of part D of FIG. 9A. FIG. 10 is a side view of another cooling roll provided in the twin-roll continuous caster. FIGS. 11A and 11B are explanatory diagrams about the lengths of diagonal ridges.

It should be noted that though each of FIGS. 9A and 10 shows only one of the pair of cooling rolls 11, the other cooling roll 11 also has the same configuration as this one. Further, the overall configuration of the twin-roll continuous caster of the third embodiment is similar to that of the aforementioned first embodiment (see FIGS. 1 and 2), and therefore will not be described in detail here.

As shown in FIG. 7, in this twin-roll continuous caster, multiple cooling nozzles 31 as cast-piece cooling means are disposed at both sides of the cast piece 16 drawn out from the kissing point KP. Thus, the cast piece 16 can be cooled by spraying, on both side surfaces of the cast piece 16, cooling water 32 as a liquid cooling medium sent from a cooling water feed unit of unillustrated cast-piece cooling means.

In this case, if the ridges 17 are formed along the entire circumference of the cooling roll 11 (see FIG. 2), the cooling water 32 sprayed from the cooling nozzles 31 onto the cast piece 16 rises through valleys between the ridges 17 due to the dynamic pressure thereof as indicated by arrows E in FIG. 7, and may reach the position of the meniscus M (liquid surface of the molten steel 14) of the molten metal pool 13. The cooling water 32 rising through the valleys is heated by the high-temperature molten steel 14 through the solidified shells 15 to evaporate, and the volume of the cooling water 32 is expanded to thousand times the original volume thereof or more. Accordingly, when the cooling water 32 has reached the position of the meniscus M as indicated by arrow E in FIG. 8, bumping 33 may occur or the solidified shell 15 may break, because the molten steel static pressure in the vicinity of the meniscus M is low. If the bumping 33 occurs or the solidified shell 15 breaks, solidified shell thickness becomes uneven in that portion, and breakout may be caused.

To cope with this, in the third embodiment, the ridges 17 are discontinuous in the circumferential direction of the cooling roll 11 as shown in FIGS. 9A and 9B or FIG. 10.

To be more detailed, in FIGS. 9A and 9B, the ridges 17 are discontinuous in the circumferential direction of the cooling roll 11, and the ridges 17 adjacent to each other in the circumferential direction are different in phase (the positions thereof are shifted from each other in the lateral direction of the cooling roll 11). Also, the length L of each ridge 17 along the circumferential direction is shorter than the circumferential lengths Lmka and Lmkb, such as shown in FIG. 7, from the position of the meniscus M of the molten metal pool 13 to the kissing point KP along the surface (the surface of the laterally central portion 11*b* and the surfaces of the collars 11*a*) of the cooling roll 11. Accordingly, the valleys between the ridges 17 are also discontinuous in the circumferential direction, and the lengths thereof are shorter than the circumferential lengths Lmka and Lmkb from the position of the meniscus M to the kissing point KP along the surface of the cooling roll 11.

Also in FIG. 10, the ridges 17 are discontinuous in the circumferential direction of the cooling roll 11 (not different in phase). Also, the length L of each ridge 17 along the circumferential direction is shorter than the circumferential lengths Lmka and Lmkb, such as shown in FIG. 7, from the position of the meniscus M of the molten metal pool 13 to the kissing point KP along the surface (the surface of the laterally central portion 11*b* and the surfaces of the collars 11*a*) of the cooling roll 11. Accordingly, the valleys between the ridges 17 are also discontinuous in the circumferential direction, and the lengths thereof are shorter than the circumferential lengths Lmka and Lmkb from the position of the meniscus M to the kissing point KP along the surface of the cooling roll 11.

It should be noted that the ridges 17 may be formed diagonally with respect to the circumferential direction of the cooling roll 11, as shown in FIGS. 11A and 11B. In this case (including the case of a spiral ridge), not the length (diagonal length) of the diagonal ridge 17 in the length direction, but the length L of the ridge 17 in the circumferential direction of the cooling roll 11 is made shorter than the lengths Lmka and Lmkb from the position of the meniscus M to the kissing point KP along the surface of the cooling roll 11.

As described above, the twin-roll continuous caster of the third embodiment has the following features: the ridges 17 formed on the surfaces of each of the pair of cooling rolls 11 are discontinuous in the circumferential direction of the cooling roll 11; and the length L of each discontinuous ridge 17 in the circumferential direction is shorter than the circumferential lengths from the position of the meniscus M of the molten metal pool 13 to the kissing point KP along the surface of the cooling roll 11. Accordingly, the cooling water 32 sprayed on the cast piece 16 by the cast-piece cooling means can be prevented from rising through the valleys between the ridges 17 and reaching the position of the meniscus M of the molten metal pool 13.

Fourth Embodiment

Figure 12:
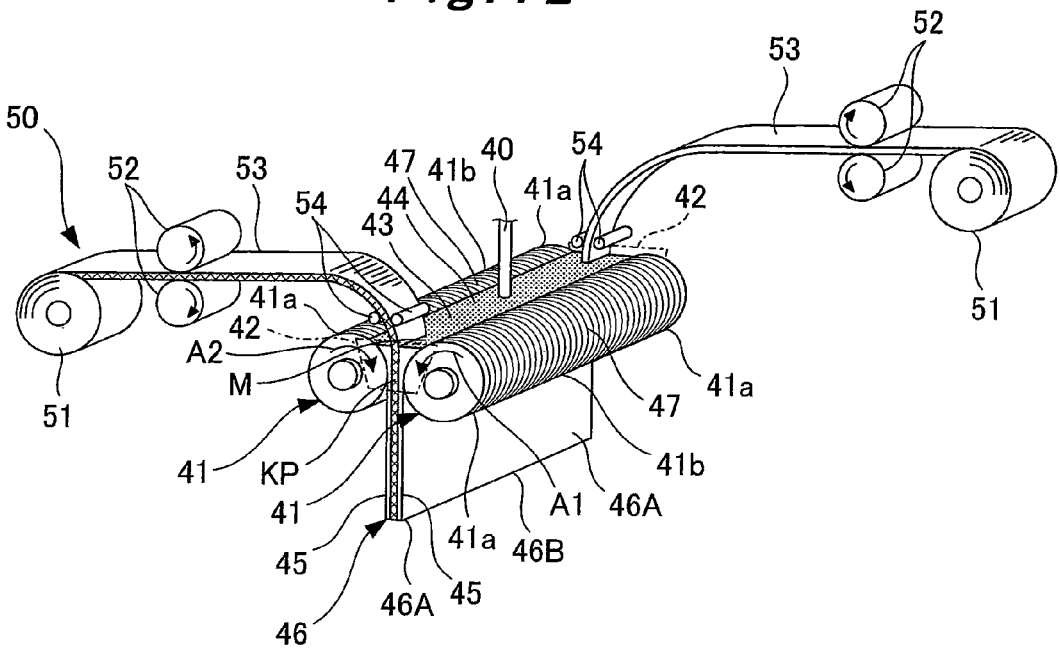
FIG. 12 is a perspective view of a twin-roll continuous caster according to a fourth embodiment of the present invention.
Figure 13:
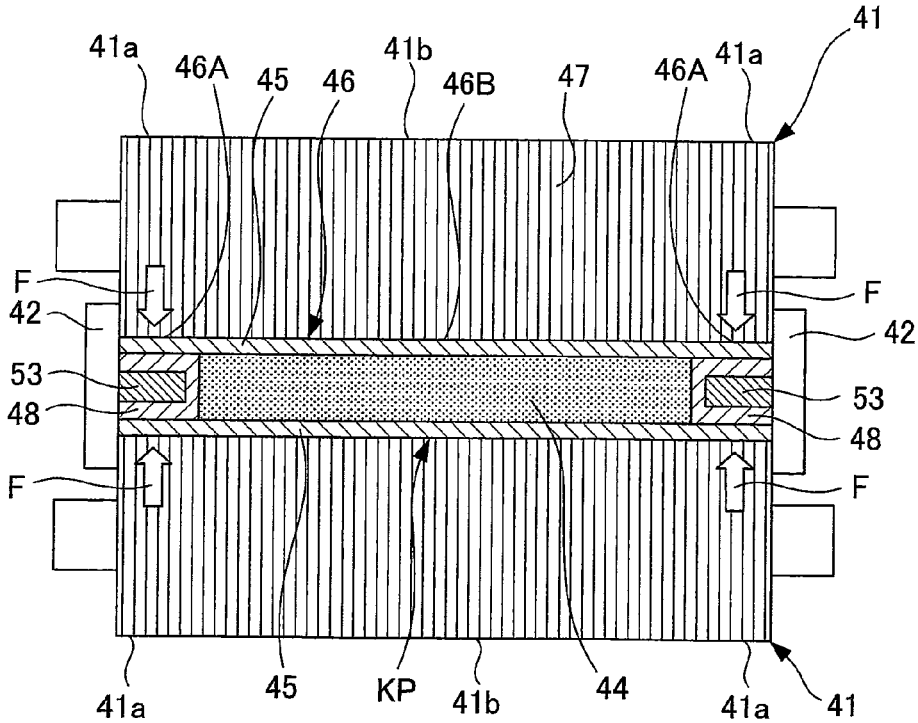
FIG. 13 is a top view of the above-described twin-roll continuous caster.

FIG. 12 is a perspective view of a twin-roll continuous caster according to a fourth embodiment of the present invention. FIG. 13 is a top view of the twin-roll continuous caster.

As shown in FIGS. 12 and 13, the twin-roll continuous caster of the fourth embodiment includes a pair of cooling rolls 41 and a pair of edge dams 42. The cooling rolls 41 are placed parallel and close to each other at the same height. The edge dams 42 are respectively placed on laterally opposite sides of the cooling rolls 41 and in contact with laterally opposite end portions (axial end portions; left and right end portions in FIG. 13) of each cooling roll 41. The space which is between the pair of cooling rolls 41 and bracketed by the edge dams 42 is a molten metal pool 43. This molten metal pool 43 is supplied with molten steel 44 as molten metal through a nozzle 40 from unillustrated supply means such as a tundish, wherein the molten steel 44 is pooled.

Each of the pair of cooling rolls 41 is a flat roll (without collars) in the shape of a cylinder (or column) and made of a copper alloy or the like.

This twin-roll continuous caster further includes a cooling medium feeder 50 as cooling medium feeding means. The cooling medium feeder 50 feeds cooling media 53 into the space between the pair of cooling rolls 41 at the laterally opposite end portions 41*a* thereof. Each of these cooling media 53 is a strip of an iron-based material, preferably the same material as molten steel 44 or a similar material.

Specifically, the cooling medium feeder 50 includes two component groups, each of which includes a payoff reel 51, transport rolls 52, and guide rolls 54. The two component groups are provided at laterally opposite end portions of the cooling rolls 41, respectively. The payoff reels 51 continuously pay out the cooling media 53 in synchronization with the drawing speed (rotation speeds of the cooling rolls 41) of a cast piece 46. The paid-out cooling media 53 are transported by the transport rolls 52, guided by the guide rolls 54 (may be replaced with guide plates), and continuously fed downward into the space between the pair of cooling rolls 41 at the laterally opposite end portions 41*a* thereof in the molten metal pool 43.

Accordingly, when the pair of cooling rolls 41 are rotated in opposite directions (see arrows A1 and A2 in FIG. 12) by unillustrated rotation drive means, the molten steel 44 supplied to the molten metal pool 43 is cooled by making contact with the surfaces (the surfaces of the laterally central portions 41*b* and the surfaces of the laterally opposite end portions 41*a*) of the pair of cooling rolls 41 to solidify into solidified shells 45, respectively. These solidified shells 45 grow with the rotation of the cooling rolls 41. At this time, also on the surfaces of the cooling media 53 continuously fed from the cooling medium feeder 50 in synchronization with the rotation of the cooling rolls 41, the molten steel 44 is cooled by making contact with the surfaces of the cooling media 53, and solidified shells 48 are thus formed to surround the cooling media 53. These solidified shells 48 grow with the travel of the cooling media 53 in the molten steel 44.

At a kissing point KP (position at which the distance between the cooling rolls 41 is smallest) in the space (molten metal pool 43) between the pair of cooling rolls 41, laterally opposite edges of the solidified shells 45 and the solidified shells 48 are pressed and bonded to each other by the laterally opposite end portions 41*a* of the pair of cooling rolls 41 as indicated by arrows F in FIG. 13. Specifically, the laterally opposite edges are produced by cooling and solidifying the molten steel 44 on the surfaces of the laterally opposite end portions 41*a* of the pair of cooling rolls 41, and the solidified shells 48 are produced by cooling and solidifying the molten steel 44 on the surfaces of the cooling media 53. Thus, laterally opposite edges 46A (left and right edges in FIG. 13, hereinafter referred to as cast-piece edges) of a cast piece 46 are generated (cast-piece-edge generation means).

Also, at this time, unsolidified molten steel 44 remains between the laterally central portions of the solidified shells 45, and a portion (portion between the cast-piece edges 46A) containing this unsolidified molten steel 44 becomes a laterally central portion 46B (hereinafter referred to as a cast-piece center) of the cast piece 46. In this way, the pouched cast piece 46 including the cast-piece center 46B containing the unsolidified molten steel 44 and the cast-piece edges 46A (portions not containing the unsolidified molten steel 44) is continuously casted.

The surfaces (the surfaces of the laterally central portions 41*b* and the surfaces of the laterally opposite end portions 41*a*) of the pair of cooling rolls 41 have a large number of ridges 47 formed along the entire circumferences of the cooling rolls 41. This uniformizes the thicknesses of the solidified shells 45 when the cast piece 46 is casted as described above.

It should be noted that the ridges 47 may be formed diagonally with respect to the circumferential directions of the cooling rolls 41 or formed along the lateral directions of the cooling rolls 41, instead of being formed along the circumferential directions of the cooling rolls 41 as described above.

As described above, the twin-roll continuous caster of the fourth embodiment is a twin-roll continuous caster configured to cast the molten steel 44 supplied to the molten metal pool 43 between the pair of cooling rolls 41 into the cast piece 46 by cooling and solidifying the molten steel 44 on the surfaces of the pair of cooling rolls 41. This twin-roll continuous caster has the following features: the ridges 47 are formed on the surfaces of the pair of cooling rolls 41; the cast-piece edges 46A are generated by cooling and solidifying the molten steel 44 with the cast-piece-edge generation means (laterally opposite end portions 41*a* and cooling media 53) provided at the laterally opposite end portions of the pair of cooling rolls 41; and the cast-piece center 46B containing the unsolidified molten steel 44 between the solidified shells 45 is generated by cooling and solidifying the molten steel 44 on the surfaces of the laterally central portions 41*b* of the pair of cooling rolls 41. Accordingly, unlike conventional strip casters, solidified shells do not need to be pressed and bonded to each other by the entire surfaces of cooling rolls. The surfaces of the laterally central portions 41*b* of the cooling rolls 41 are only subject to the static pressure of the molten steel 44 from the cast-piece center 46B containing the unsolidified molten steel 44, i.e., only subject to a line pressure (e.g., 0.01 kg/mm or less) much lower than line pressures described in Patent Literatures 3 and 4, which are approximately 1 kg/mm to 25 kg/mm and approximately 9 kg/mm to 40 kg/mm.

Accordingly, it is possible to reduce the damage and wear of the ridges 47 formed on the surfaces of the laterally central portions 41*b* of the cooling rolls 41, maintain the shapes of the ridges 47 for a long period, and maintain effects such as the uniformization of solidified shell thicknesses (cast-piece thicknesses) by the ridges 47 for a long period. That is, it is possible to maintain, for a long period, the function of uniformizing the thicknesses in the cast-piece center 46B which is more important than the cast-piece edges 46A to be cut away in a step after casting. Thus, the life of the cooling rolls 41 can be increased.

Moreover, the twin-roll continuous caster of the fourth embodiment has the following features: the cast-piece-edge generation means has a configuration (second configuration) in which the cast-piece edges 46A are generated by pressing and bonding the laterally opposite edges of the solidified shells 45 and the solidified shells 48 to each other, by the laterally opposite end portions 41*a* of the pair of cooling rolls 41. Specifically, the laterally opposite edges of the solidified shells 45 are produced by cooling and solidifying the molten steel 44 on the surfaces of the laterally opposite end portions 41*a* of the pair of cooling rolls 41; and the solidified shells 48 are produced by cooling and solidifying the molten steel 44 on the surfaces of the cooling media 53 fed from the cooling medium feeder 50 into the space between the pair of cooling rolls at the laterally opposite end portions 41*a* thereof. Accordingly, the cast-piece edges 46A can reliably be generated with a simple configuration to reliably encapsulate the unsolidified molten steel 44 between the solidified shells 45.

It should be noted that though not shown, also in the fourth embodiment, the shapes of the transverse cross sections (cross sections taken in the lateral directions of the cooling rolls 41) of the ridges 47 are made triangular (see FIGS. 3 and 4) similar to the shapes of the transverse cross sections of the ridges 17 in the first embodiment. Further, the tops of the ridges 47 formed on the laterally opposite end portions 41*a* of the cooling rolls 41 may be rounded as in the ridges 17 of FIG. 5A or flatted as in the ridges 17 of FIG. 5B. Moreover, the laterally opposite end portions 41*a* of the cooling rolls 41 may not have the ridges 47, but may have the surfaces thereof flatted similar to the laterally opposite end portions (collars 11*a*) of the cooling rolls 11 shown in FIG. 5C, or may have a large number of dimples formed in the surfaces thereof similar to the laterally opposite end portions (collars 11*a*) of the cooling rolls 11 shown in FIG. 5D.

Furthermore, similar to the second embodiment, also in the fourth embodiment, each cooling roll 41 preferably has greater hardnesses at the surfaces of the laterally opposite end portions 41*a* thereof than at the surface of a portion (laterally central portion 41*b*) thereof other than the laterally opposite end portions 41*a*.

Also, as in the third embodiment, it is preferable that each ridge 47 of the fourth embodiment be discontinuous in the circumferential direction of the cooling roll 41 and that the length of each ridge 47 along the circumferential direction be made shorter than the circumferential lengths, such as shown in FIG. 12, from the position of the meniscus M of the molten metal pool 43 to the kissing point KP along the surface of the cooling roll 41.

Further, though the above description has been made for the case where the ridges 47 are formed on the surfaces of the cooling rolls 41, instead of the ridges 47, projections (not protrusions, such as ridges, having shapes extending along the surfaces of the cooling rolls, but protrusions having conical shapes, pyramidal shapes, or the like and scattered on the surfaces of the cooling rolls) may be formed on the surfaces of the cooling rolls 41. It should be noted, however, that also in this case, the tops of the projections in the laterally opposite end portions 41*a* of the cooling rolls 41 are preferably rounded or flatted as in the case of ridges. Further, the laterally opposite end portions 41*a* of the cooling rolls 41 may have no projections or may have dimples.

Fifth Embodiment

Figure 14:
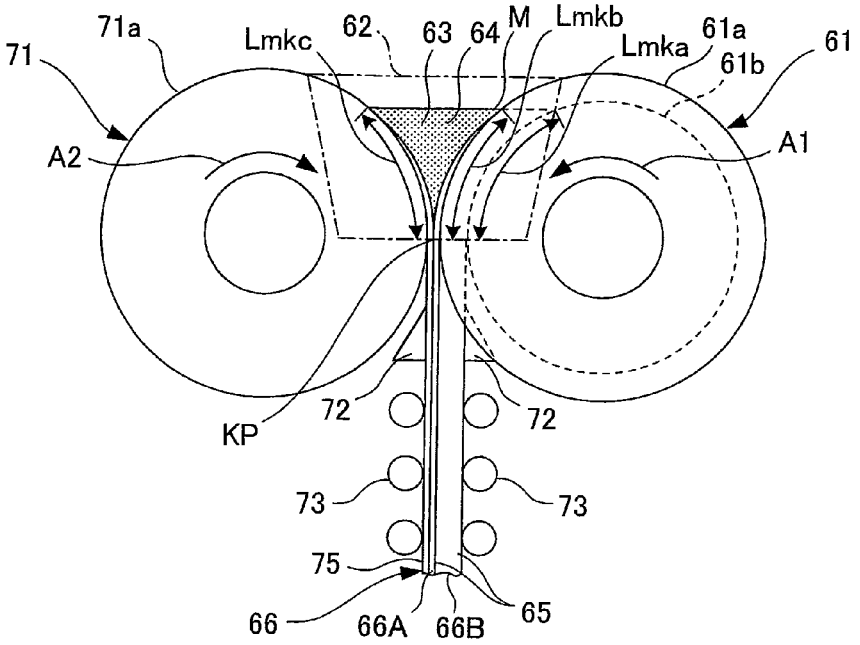
FIG. 14 is a front view of a twin-roll continuous caster according to a fifth embodiment of the present invention.
Figure 15:
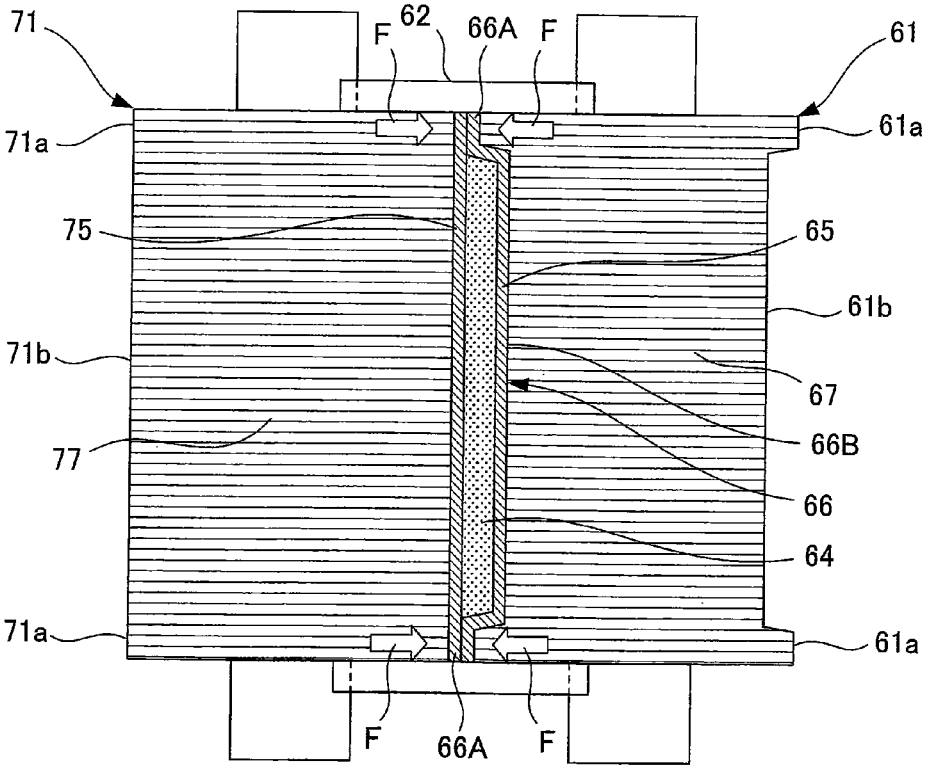
FIG. 15 is a top view of the above-described twin-roll continuous caster.
Figure 16:
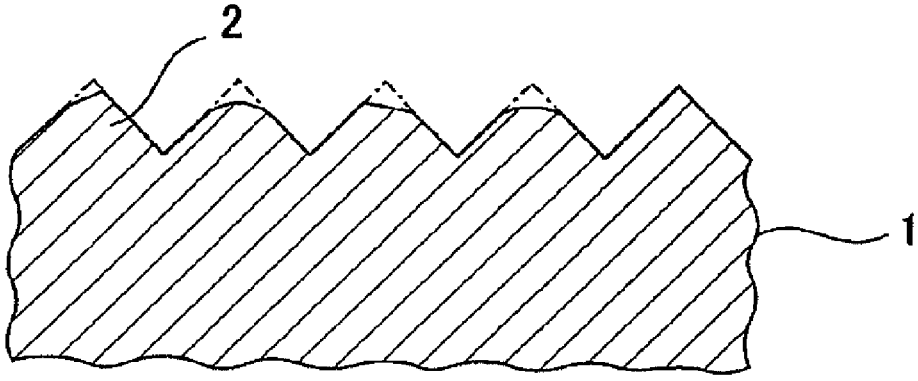
PRIOR ART Fig. 16
FIG. 16 is an explanatory diagram showing a problem which may occur in the case where projections or ridges are formed on the surface of a cooling roll.

FIG. 14 is a front view of a twin-roll continuous caster according to a fifth embodiment of the present invention. FIG. 15 is a top view of the twin-roll continuous caster.

As shown in FIGS. 14 and 15, the twin-roll continuous caster of the fifth embodiment includes a pair of cooling rolls 61 and 71 and a pair of edge dams 62. The cooling rolls 61 and 71 are placed parallel and close to each other at the same height. The edge dams 62 are respectively placed on laterally opposite sides of the cooling rolls 61 and 71 and in contact with laterally opposite end portions (axial end portions; upper and lower end portions in FIG. 15) of each of the cooling rolls 61 and 71. The space which is between the pair of cooling rolls 61 and 71 and bracketed by the edge dams 62 is a molten metal pool 63. This molten metal pool 63 is supplied with molten steel 64 as molten metal through a nozzle from unillustrated supply means such as a tundish, wherein the molten steel 64 is pooled.

One cooling roll 61 is a cylinder (or column) made of a copper alloy or the like, and has collars 61*a* at the laterally opposite end portions thereof along the entire circumference of the cooling roll 61. The outside diameter of each collar 61*a* is greater than the outside diameter of a laterally central portion 61*b* (portion between the collars 61*a*) of the cooling roll 61. The other cooling roll 71 is a flat roll (without collars) in the shape of a cylinder (or column) and made of a copper alloy or the like.

Accordingly, when the pair of cooling rolls 61 and 71 are rotated in opposite directions (see arrows A1 and A2 in FIG. 14) by unillustrated rotation drive means, the molten steel 64 supplied to the molten metal pool 63 is cooled by making contact with the surface (the surface of the laterally central portion 61*b* and the surfaces of the collars 61*a*) of one cooling roll 61 and the surface (the surface of the laterally central portion 71*b* and the surfaces of the laterally opposite end portions 71*a*) of the other cooling roll 71 to solidify into a solidified shell 65 and a solidified shell 75, respectively. These solidified shells 65 and 75 grow with the rotation of the cooling rolls 61 and 71.

At a kissing point KP (position at which the distance between the cooling rolls 61 and 71 is smallest) in the space (molten metal pool 63) between the pair of cooling rolls 61 and 71, the laterally opposite end portions of the solidified shell 65 and the laterally opposite end portions of the solidified shell 75 are pressed and bonded to each other by the collars 61*a* of one cooling roll 61 and the laterally opposite end portions 71*a* of the other cooling roll 71 as indicated by arrows F in FIG. 15. Specifically, the laterally opposite end portions of the solidified shell 65 are produced by cooling and solidifying the molten steel 64 on the surfaces of the collars 61*a* formed at the laterally opposite end portions of one cooling roll 61, and the laterally opposite end portions of the solidified shell 75 are produced by cooling and solidifying the molten steel 64 on the surfaces of the laterally opposite end portions 71*a* of the other cooling roll 71. Thus, laterally opposite edges 66A (upper and lower edges in FIG. 15, hereinafter referred to as cast-piece edges) of a cast piece 66 are generated (cast-piece-edge generation means).

Also, at this time, unsolidified molten steel 64 remains between the laterally central portions of the solidified shells 65 and 75, and a portion (i.e., a portion between the cast-piece edges 66A) which contains this unsolidified molten steel 64 becomes a laterally central portion 66B (hereinafter referred to as a cast-piece center) of the cast piece 66. In this way, the pouched cast piece 66 including the cast-piece center 66B containing the unsolidified molten steel 64 and the cast-piece edges 66A (portions not containing the unsolidified molten steel 64) is continuously casted. It should be noted that in the shown example, the cast piece 66 drawn out from the kissing point KP is supported by support members 72 and support rolls 73.

The surface (the surface of the laterally central portion 61*b* and the surfaces of the collars 61*a*) of one cooling roll 61 has a large number of ridges 67 formed along the entire circumference of the cooling roll 61. This uniformizes the thickness of the solidified shell 65 when the molten steel 64 is cooled on the surface of the cooling roll 61 to produce the solidified shell 65. Similarly, the surface (the surface of the laterally central portion 71*b* and the surfaces of the laterally opposite end portions 71*a*) of the other cooling roll 71 also has a large number of ridges 77 formed along the entire circumference of the cooling roll 71. This uniformizes the thickness of the solidified shell 75 when the molten steel 64 is cooled on the surface of the cooling roll 71 to produce the solidified shell 75.

It should be noted that the ridges 67 and 77 may be formed diagonally with respect to the circumferential directions of the cooling rolls 61 and 71 or formed along the lateral directions of the cooling rolls 61 and 71, instead of being formed along the circumferential directions of the cooling rolls 61 and 71 as described above.

As described above, the twin-roll continuous caster of the fifth embodiment is a twin-roll continuous caster configured to cast the molten steel 64 supplied to the molten metal pool 63 between the pair of cooling rolls 61 and 71 into the cast piece 66 by cooling and solidifying the molten steel 64 on the surfaces of the pair of cooling rolls 61 and 71. This twin-roll continuous caster has the following features: the ridges 67 and 77 are formed on the surfaces of the pair of cooling rolls 61 and 71; the cast-piece edges 66A are generated by cooling and solidifying the molten steel 64 with the cast-piece-edge generation means (collars 61*a* and laterally opposite end portions 71*a*) provided at laterally opposite sides of the pair of cooling rolls 61 and 71; and the cast-piece center 66B containing the unsolidified molten steel 64 between the solidified shells 65 and 75 is generated by cooling and solidifying the molten steel 64 on the surfaces of the laterally central portions 61*b* and 71*b* of the pair of cooling rolls 61 and 71. Accordingly, unlike conventional strip casters, solidified shells do not need to be pressed and bonded to each other by the entire surfaces of cooling rolls. The surfaces of the laterally central portions 61*b* and 71*b* of the cooling rolls 61 and 71 are only subject to the static pressure of the molten steel 64 from the cast-piece center 66B containing the unsolidified molten steel 64, i.e., only subject to a line pressure (e.g., 0.01 kg/mm or less) much lower than line pressures described in Patent Literatures 3 and 4, which are approximately 1 kg/mm to 25 kg/mm and approximately 9 kg/mm to 40 kg/mm.

Accordingly, it is possible to reduce the damage and wear of the ridges 67 and 77 formed on the surfaces of the laterally central portions 61*b* and 71*b* of the cooling rolls 61 and 71, maintain the shapes of the ridges 67 and 77 for a long period, and maintain effects such as the uniformization of solidified shell thicknesses (cast-piece thicknesses) by the ridges 67 and 77 for a long period. That is, it is possible to maintain, for a long period, the function of uniformizing the thicknesses in the cast-piece center 66B which is more important than the cast-piece edges 66A to be cut away in a step after casting. Thus, the life of the cooling rolls 61 and 71 can be increased.

Moreover, the twin-roll continuous caster of the fifth embodiment has the following feature: the cast-piece-edge generation means has a configuration (third configuration) in which the cast-piece edges 66A are generated by pressing and bonding the laterally opposite edges of the solidified shell 65 and the laterally opposite edges of the solidified shell 75 to each other, by the collars 61*a* of one cooling roll 61 and the laterally opposite end portions 71*a* of the other cooling roll 71. Specifically, the laterally opposite edges of the solidified shell 65 are produced by cooling and solidifying the molten steel 64 on the surfaces of the collars 61*a* formed at laterally opposite end portions of one cooling roll 61, and the laterally opposite edges of the solidified shell 75 are produced by cooling and solidifying the molten steel 64 on the surfaces of the laterally opposite end portions 71*a* of the other cooling roll 71. Accordingly, the cast-piece edges 66A can reliably be generated with a simple configuration to reliably encapsulate the unsolidified molten steel 64 between the solidified shells 65 and 75.

It should be noted that though not shown, also in the fifth embodiment, the shapes of the transverse cross sections (cross sections taken in the lateral directions of the cooling rolls 61 and 71) of the ridges 67 and 77 are made triangular (see FIGS. 3 and 4) similar to the shapes of the transverse cross sections of the ridges 17 in the first embodiment. Further, the tops of the ridges 67 and 77 formed on the collars 61*a* of the cooling roll 61 and the laterally opposite end portions 71*a* of the cooling roll 71 may be rounded as in the ridges 17 of FIG. 5A or flatted as in the ridges 17 of FIG. 5B. Moreover, the collars 61*a* of the cooling roll 61 and the laterally opposite end portions 71*a* of the cooling roll 71 may not have the ridges 67 and 77, but may have the surfaces thereof flatted similar to the laterally opposite end portions (collars 11*a*) of the cooling rolls 11 shown in FIG. 5C, or may have a large number of dimples formed in the surfaces thereof similar to the laterally opposite end portions (collars 11*a*) of the cooling rolls 11 shown in FIG. 5D.

Furthermore, similar to the second embodiment, also in the fifth embodiment, it is preferable that the cooling roll 61 have greater hardnesses at the surfaces of the collars 61*a* thereof than at the surface of a portion (laterally central portion 61*b*) thereof other than the collars 61*a*, and that the cooling roll 71 have greater hardnesses at the surfaces of laterally opposite end portions 71*a* thereof than at the surface of a portion (laterally central portion 71*b*) thereof other than the laterally opposite end portions 71*a*.

Also, as in the third embodiment, it is preferable that each of the ridges 67 and 77 of the fifth embodiment be discontinuous in the circumferential direction of the cooling roll 61 or 71 and that the length of each ridge 67 or 77 in the circumferential direction be made shorter than the circumferential lengths Lmka, Lmkb, and Lmkc, such as shown in FIG. 14, from the position of the meniscus M of the molten metal pool 63 to the kissing point KP along the surface (the surface of the laterally central portion 61*b* and the surfaces of the collars 61*a*) of the cooling roll 61 and the surface of the cooling roll 71.

Further, though the above description has been made for the case where the ridges 67 and 77 are formed on the surfaces of the cooling rolls 61 and 71, instead of the ridges 67 and 77, projections (not protrusions, such as ridges, having shapes extending along the surfaces of the cooling rolls, but protrusions having conical shapes, pyramidal shapes, or the like and scattered on the surfaces of the cooling rolls) may be formed on the surfaces of the cooling rolls 61 and 71. It should be noted, however, that also in this case, the tops of the projections in the collars 61*a* of the cooling roll 61 and the laterally opposite end portions 71*a* of the cooling roll 71 are preferably rounded or flatted as in the case of ridges 67 and 77. Further, the collars 61*a* of the cooling roll 61 and the laterally opposite end portions 71*a* of the cooling roll 71 may have no projections or may have dimples.

INDUSTRIAL APPLICABILITY

The present invention relates to a twin-roll continuous caster including a pair of cooling rolls, and is useful when applied to maintaining effects of projections or ridges formed on the surfaces of the cooling rolls.

REFERENCE SIGNS LIST

11 COOLING ROLL, 11*a* COLLAR OF COOLING ROLL, 11*a*-1 SURFACE OF COLLAR, 11*a*-2 SIDE SURFACE (INCLINED SURFACE) OF COLLAR, 11*b* LATERALLY CENTRAL PORTION OF COOLING ROLL, 12 EDGE DAM, 13 MOLTEN METAL POOL, 14 MOLTEN STEEL, 15 SOLIDIFIED SHELL, 15*a* TRANSVERSE TRAVEL OF SOLIDIFIED SHELL, 16 CAST PIECE, 16A CAST-PIECE EDGE, 16B CAST-PIECE CENTER, 17 RIDGE, 17*a* TOP OF RIDGE, 21 SUPPORT MEMBER, 22 SUPPORT ROLL, 31 COOLING NOZZLE, 32 COOLING WATER, BUMPING, 40 NOZZLE, 41 COOLING ROLL, 41*a* LATERALLY OPPOSITE END PORTIONS OF COOLING ROLL, 41*b* LATERALLY CENTRAL PORTION OF COOLING ROLL, 42 EDGE DAM, 43 MOLTEN METAL POOL, 44 MOLTEN STEEL, 45 SOLIDIFIED SHELL, 46 CAST PIECE, 46A CAST-PIECE EDGE, 46B CAST-PIECE CENTER, RIDGE, 48 SOLIDIFIED SHELL, 50 COOLING MEDIUM FEEDER 51 PAYOFF REEL, 52 TRANSPORT ROLL, 53 COOLING MEDIUM, 54 GUIDE ROLL, 61 COOLING ROLL, 61*a* COLLAR OF COOLING ROLL 61*b* LATERALLY CENTRAL PORTION OF COOLING ROLL, 62 EDGE DAM, 63 MOLTEN METAL POOL, 64 MOLTEN STEEL, SOLIDIFIED SHELL, 66 CAST PIECE, 66A CAST-PIECE EDGE 66B CAST-PIECE CENTER, 67 RIDGE, 71 COOLING ROLL, 71*a* LATERALLY OPPOSITE END PORTIONS OF COOLING ROLL, 71*b* LATERALLY CENTRAL PORTION OF COOLING ROLL, 72 SUPPORT MEMBER, 73 SUPPORT ROLL, 75 SOLIDIFIED SHELL, KP KISSING POINT, M MENISCUS

The invention claimed is:

1. A twin-roll continuous caster configured to cast molten metal supplied to a molten metal pool between a pair of cooling rolls into a cast piece by cooling and solidifying the molten metal on surfaces of the pair of cooling rolls, wherein the surfaces of each of the pair of cooling rolls has end portions at both ends thereof, and a central portion extending between the both end portions, a plurality of ridges is formed in the central portion of the cooling rolls, each of the plurality of ridges is separated in a rotational direction of the cooling rolls by a plurality of discontinuous sections, and a length of each ridge in the rotation direction of the cooling rolls is longer than a length of each discontinuous section in the rotational direction, laterally opposite edges of the cast piece are generated by cooling and solidifying the molten metal with cast-piece-edge generation means provided at the end portions of each of the pair of cooling rolls, and a laterally central portion of the cast piece is generated by cooling and solidifying the molten metal on surfaces of the central portion of the pair of cooling rolls, the laterally central portion of the cast piece containing the unsolidified molten metal between solidified shells.

2. The twin-roll continuous caster according to claim 1, wherein the cast-piece-edge generation means has any one of the following:

a first configuration in which the laterally opposite edges of the cast piece are generated by pressing and bonding laterally opposite edges of one of first solidified shells to laterally opposite edges of the other one of the first solidified shells by collars formed at the end portions of each of the pair of cooling rolls, the laterally opposite edges of each of the first solidified shells being produced by cooling and solidifying the molten metal on surfaces of the collars;

a second configuration in which the laterally opposite edges of the cast piece are generated by pressing and bonding laterally opposite edges of each of second solidified shells respectively to third solidified shells by the end portions of each of the pair of cooling rolls, the laterally opposite edges of each of the second solidified shells being produced by cooling and solidifying the molten metal on surfaces of the end portions of each of the pair of cooling rolls, the third solidified shells being produced by cooling and solidifying the molten metal on surfaces of cooling media fed from cooling medium feeding means into a portion between the pair of cooling rolls at the end portions thereof; and a third configuration in which the laterally opposite edges of the cast piece are generated by pressing and bonding laterally opposite edges of fourth solidified shell to laterally opposite edges of fifth solidified shell by collars formed at the end portions of a first one of the pair of cooling rolls and by the end portions of a second one of the pair of cooling rolls, the laterally opposite edges of each of the fourth solidified shell being produced by cooling and solidifying the molten metal on surfaces of the collars of the first cooling roll of the pair of cooling rolls, the laterally opposite edges of each of the fifth solidified shell being produced by cooling and solidifying the molten metal on surfaces of the end portions of the second cooling roll.

3. The twin-roll continuous caster according to claim 2, wherein when the cast-piece-edge generation means has the first configuration, the surfaces of the collars of the pair of cooling rolls are flat with no ridges;

when the cast-piece-edge generation means has the second configuration, the surfaces of the end portions of the pair of cooling rolls are flat with no ridges; and when the cast-piece-edge generation means has the third configuration, the surfaces of the collars of the first cooling roll and the surfaces of the end portions of the second cooling roll are flat with no ridges.

4. The twin-roll continuous caster according to claim 2, wherein when the cast-piece-edge generation means has the first configuration, the ridges formed on the surfaces of the collars of each of the pair of cooling rolls have rounded or flatted tops;

when the cast-piece-edge generation means has the second configuration, the ridges formed on the end portions of each of the pair of cooling rolls have rounded or flatted tops; and when the cast-piece-edge generation means has the third configuration, the ridges formed on the surfaces of the collars of the first cooling roll and the surfaces of the end portions of the second cooling roll have rounded or flatted tops.

5. The twin-roll continuous caster according to claim 2, wherein when the cast-piece-edge generation means has the first configuration, the pair of cooling rolls have the ridges on the surfaces of the collars thereof and have greater hardnesses at the surfaces of the collars thereof than at surfaces of portions thereof other than the collars;

when the cast-piece-edge generation means has the second configuration, the pair of cooling rolls have the ridges on the surfaces of the end portions thereof and have greater hardnesses at the surfaces of the end portions thereof than at surfaces of portions thereof other than the laterally opposite end portions; and when the cast-piece-edge generation means has the third configuration, the first cooling roll has the ridges on the surfaces of the collars thereof and has greater hardnesses at the surfaces of the collars thereof than at a surface of a portion thereof other than the collars, and the second cooling roll has the ridges on the surfaces of the end portions thereof and has greater hardnesses at the surfaces of the end portions thereof than at a surface of a portion thereof other than the laterally opposite end portions.

6. The twin-roll continuous caster according to claim 1, wherein the ridges are formed on the surface of each of the pair of cooling rolls, and a length of the ridge between the discontinuous sections is shorter than a circumferential length from a position of a meniscus of the molten metal pool to a kissing point along the surface of the cooling roll.

7. A twin-roll continuous caster configured to cast molten metal supplied to a molten metal pool between a pair of cooling rolls into a cast piece by cooling and solidifying the molten metal on surfaces of the pair of cooling rolls, wherein the surfaces of each of the pair of cooling rolls has end portions at both ends thereof, and a central portion extending between the both end portions, ridges are formed in the central portion, each ridge extends in an oblique direction with respect to a rotational direction of a cooling roll without discontinuous sections, laterally opposite edges of the cast piece are generated by cooling and solidifying the molten metal with cast-piece-edge generation means provided at the end portions of each of the pair of cooling rolls, and a laterally central portion of the cast piece is generated by cooling and solidifying the molten metal on surfaces of the central portion of the pair of cooling rolls, the laterally central portion of the cast piece containing the unsolidified molten metal between solidified shells.

8. A twin-roll continuous caster configured to cast molten metal supplied to a molten metal pool between a pair of cooling rolls into a cast piece by cooling and solidifying the molten metal on surfaces of the pair of cooling rolls, wherein the surfaces of each of the pair of cooling rolls has end portions at both ends thereof, and a central portion extending between the both end portions, a plurality of projections or ridges is formed in the central portion, each projection or ridge is separated in a rotational direction of the cooling rolls by a plurality of discontinuous sections, and a length of each projection or ridge in the rotational direction is longer than a length of each discontinuous section in the rotational direction, laterally opposite edges of the cast piece are generated by cooling and solidifying the molten metal with cast-piece-edge generation means provided at the end portions of each of the pair of cooling rolls, and a laterally central portion of the cast piece is generated by cooling and solidifying the molten metal on surfaces of the central portion of the pair of cooling rolls, the laterally central portion of the cast piece containing the unsolidified molten metal between solidified shells, wherein the cast-piece-edge generation means has any one of the following:

a first configuration in which the laterally opposite edges of the cast piece are generated by pressing and bonding laterally opposite edges of one of first solidified shells to laterally opposite edges of the other one of the first solidified shells by collars formed at the end portions of each of the pair of cooling rolls, the laterally opposite edges of each of the first solidified shells being produced by cooling and solidifying the molten metal on surfaces of the collars;

a second configuration in which the laterally opposite edges of the cast piece are generated by pressing and bonding laterally opposite edges of each of second solidified shells respectively to third solidified shells by the end portions of each of the pair of cooling rolls, the laterally opposite edges of each of the second solidified shells being produced by cooling and solidifying the molten metal on surfaces of the end portions of each of the pair of cooling rolls, the third solidified shells being produced by cooling and solidifying the molten metal on surfaces of cooling media fed from cooling medium feeding means into a portion between the pair of cooling rolls at the end portions thereof; and a third configuration in which the laterally opposite edges of the cast piece are generated by pressing and bonding laterally opposite edges of fourth solidified shell to laterally opposite edges of fifth solidified shell by collars formed at the end portions of a first one of the pair of cooling rolls and by the end portions of a second one of the pair of cooling rolls, the laterally opposite edges of each of the fourth solidified shell being produced by cooling and solidifying the molten metal on surfaces of the collars of the first cooling roll of the pair of cooling rolls, the laterally opposite edges of each of the fifth solidified shell being produced by cooling and solidifying the molten metal on surfaces of the end portions of the second cooling roll, and wherein when the cast-piece-edge generation means has the first configuration, the projections or ridges formed on the surfaces of the collars of each of the pair of cooling rolls have rounded or flatted tops;

when the cast-piece-edge generation means has the second configuration, the projections or ridges formed on the end portions of each of the pair of cooling rolls have rounded or flatted tops; and when the cast-piece-edge generation means has the third configuration, the projections or ridges formed on the surfaces of the collars of the first cooling roll and the surfaces of the end portions of the second cooling roll have rounded or flatted tops.

9. A twin-roll continuous caster configured to cast molten metal supplied to a molten metal pool between a pair of cooling rolls into a cast piece by cooling and solidifying the molten metal on surfaces of the pair of cooling rolls, wherein the surfaces of each of the pair of cooling rolls has end portions at both ends thereof, and a central portion extending between the both end portions, a plurality of projections or ridges is formed in the central portion, each projection or ridge is separated in a rotational direction by a plurality of discontinuous sections, and a length of the projection or ridge in the rotational direction is longer than a length of each discontinuous section in the rotational direction, laterally opposite edges of the cast piece are generated by cooling and solidifying the molten metal with cast-piece-edge generation means provided at the end portions of each of the pair of cooling rolls, and a laterally central portion of the cast piece is generated by cooling and solidifying the molten metal on surfaces of the central portion of the pair of cooling rolls, the laterally central portion of the cast piece containing the unsolidified molten metal between solidified shells, wherein the cast-piece-edge generation means has any one of the following:

a first configuration in which the laterally opposite edges of the cast piece are generated by pressing and bonding laterally opposite edges of one of first solidified shells to laterally opposite edges of the other one of the first solidified shells by collars formed at the end portions of each of the pair of cooling rolls, the laterally opposite edges of each of the first solidified shells being produced by cooling and solidifying the molten metal on surfaces of the collars;

a second configuration in which the laterally opposite edges of the cast piece are generated by pressing and bonding laterally opposite edges of each of second solidified shells respectively to third solidified shells by the end portions of each of the pair of cooling rolls, the laterally opposite edges of each of the second solidified shells being produced by cooling and solidifying the molten metal on surfaces of the end portions of each of the pair of cooling rolls, the third solidified shells being produced by cooling and solidifying the molten metal on surfaces of cooling media fed from cooling medium feeding means into a portion between the pair of cooling rolls at the end portions thereof; and a third configuration in which the laterally opposite edges of the cast piece are generated by pressing and bonding laterally opposite edges of fourth solidified shell to laterally opposite edges of fifth solidified shell by collars formed at the end portions of a first one of the pair of cooling rolls and by the end portions of a second one of the pair of cooling rolls, the laterally opposite edges of each of the fourth solidified shell being produced by cooling and solidifying the molten metal on surfaces of the collars of the first cooling roll of the pair of cooling rolls, the laterally opposite edges of each of the fifth solidified shell being produced by cooling and solidifying the molten metal on surfaces of the end portions of the second cooling roll, and wherein when the cast-piece-edge generation means has the first configuration, the pair of cooling rolls have the projections or ridges on the surfaces of the collars thereof and have greater hardnesses at the surfaces of the collars thereof than at surfaces of portions thereof other than the collars;

when the cast-piece-edge generation means has the second configuration, the pair of cooling rolls have the projections or ridges on the surfaces of the end portions thereof and have greater hardnesses at the surfaces of the end portions thereof than at surfaces of portions thereof other than the laterally opposite end portions; and when the cast-piece-edge generation means has the third configuration, the first cooling roll has the projections or ridges on the surfaces of the collars thereof and has greater hardnesses at the surfaces of the collars thereof than at a surface of a portion thereof other than the collars, and the second cooling roll has the projections or ridges on the surfaces of the end portions thereof and has greater hardnesses at the surfaces of the end portions thereof than at a surface of a portion thereof other than the laterally opposite end portions.

* * * * *